US012049742B2

(12) United States Patent
Huissoon

(10) Patent No.: US 12,049,742 B2
(45) Date of Patent: Jul. 30, 2024

(54) MOBILE DEVICE

(71) Applicant: Hudson Delta B.V., SC's-Heer Arendskerke (NL)

(72) Inventor: Leendert Wilhelmus Cornelis Huissoon, SC's-Heer Arendskerke (NL)

(73) Assignee: Hudson Delta B.V., SC 'S-Heer Arendskerke (NL)

( * ) Notice: Subject to any disclaimer, the term of this patent is extended or adjusted under 35 U.S.C. 154(b) by 456 days.

(21) Appl. No.: 17/421,150

(22) PCT Filed: Jan. 10, 2020

(86) PCT No.: PCT/NL2020/050012
§ 371 (c)(1),
(2) Date: Jul. 7, 2021

(87) PCT Pub. No.: WO2020/145823
PCT Pub. Date: Jul. 16, 2020

(65) Prior Publication Data

US 2022/0081873 A1 Mar. 17, 2022

(30) Foreign Application Priority Data

Jan. 10, 2019 (NL) ..... 2022360

(51) Int. Cl.
*E02F 3/43* (2006.01)
*E02F 3/36* (2006.01)
*E02F 9/20* (2006.01)

(52) U.S. Cl.
CPC ..... *E02F 3/437* (2013.01); *E02F 3/3609* (2013.01); *E02F 3/436* (2013.01); *E02F 9/205* (2013.01)

(58) Field of Classification Search
CPC ..... E02F 3/437; E02F 3/3609; E02F 9/205; G05D 2201/0202
(Continued)

(56) References Cited

U.S. PATENT DOCUMENTS 6,668,471 B1 * 12/2003 Cook ..... E02F 3/7618 37/410
9,827,678 B1 * 11/2017 Gilbertson ..... A47L 11/4055
(Continued)

FOREIGN PATENT DOCUMENTS

EP 2185381 B1 * 6/2012 ..... B60K 25/06
EP 2508680 A1 10/2012
(Continued)

OTHER PUBLICATIONS

Jun Gu, "Design of Robotic Excavator Arm Control Utilizing Proportional-Integral-Plus," 2008, Publisher: IEEE.*
(Continued)

*Primary Examiner* — Tuan C To
(74) *Attorney, Agent, or Firm* — KDW Firm PLLC

(57) ABSTRACT

Mobile device includes a frame with displacement means, a working arm connected to the frame including at least a first and a second articulation which are hinged to each other. The working arm is hinged to the frame, and at least a first, second and third control devices are adapted for moving the first and second articulation of the working arm and a tool, respectively, at a free end of the second articulation. A control system is adapted for controlling the first, second and third control means. The control system is adapted to drive the first, second and third control means such that the free end of the second articulation follows a predetermined upward movement along an upwardly directed path and the tool remains in a lifting position, the first, second and third control means are simultaneously controlled.

18 Claims, 23 Drawing Sheets

(58) Field of Classification Search
USPC ..... 701/50
See application file for complete search history.

(56) References Cited

U.S. PATENT DOCUMENTS

| | | | | |
|---|---|---|---|---|
| 10,221,049 | B1 * | 3/2019 | Horton | B66F 9/065 |
| 10,697,152 | B2 * | 6/2020 | Izumikawa | E02F 9/261 |
| 11,319,193 | B2 * | 5/2022 | Stilborn | B66C 23/00 |
| 11,662,246 | B2 * | 5/2023 | Zimmerman | G01G 19/083 177/139 |
| 2009/0158625 | A1 * | 6/2009 | Pope | E02F 3/435 700/213 |
| 2009/0223355 | A1 * | 9/2009 | Manders | F42B 33/062 89/1.13 |
| 2011/0029175 | A1 * | 2/2011 | Kang | B60W 20/50 903/903 |
| 2012/0240753 | A1 * | 9/2012 | Watson | F41H 11/22 89/1.13 |
| 2013/0149095 | A1 * | 6/2013 | Huissoon | E02F 3/325 180/53.1 |
| 2013/0325235 | A1 * | 12/2013 | Kurikuma | E02F 9/2246 701/22 |
| 2014/0166362 | A1 | 6/2014 | Farmer | |
| 2015/0240445 | A1 | 8/2015 | Guo et al. | |
| 2018/0163364 | A1 * | 6/2018 | Huissoon | E02F 9/003 |
| 2019/0127194 | A1 * | 5/2019 | Hansen | E02F 3/96 |
| 2022/0097621 | A1 * | 3/2022 | Nakamura | E02F 9/2037 |

FOREIGN PATENT DOCUMENTS

| | | | | |
|---|---|---|---|---|
| GB | 2392431 | A * | 3/2004 | B66F 9/0655 |
| WO | WO-2011152709 | A2 * | 12/2011 | B60K 25/06 |

OTHER PUBLICATIONS

International Search Report and Written Opinion mailed for PCT/NL2002/050012 filed Jan. 10, 2020.

* cited by examiner

Figure 3G:
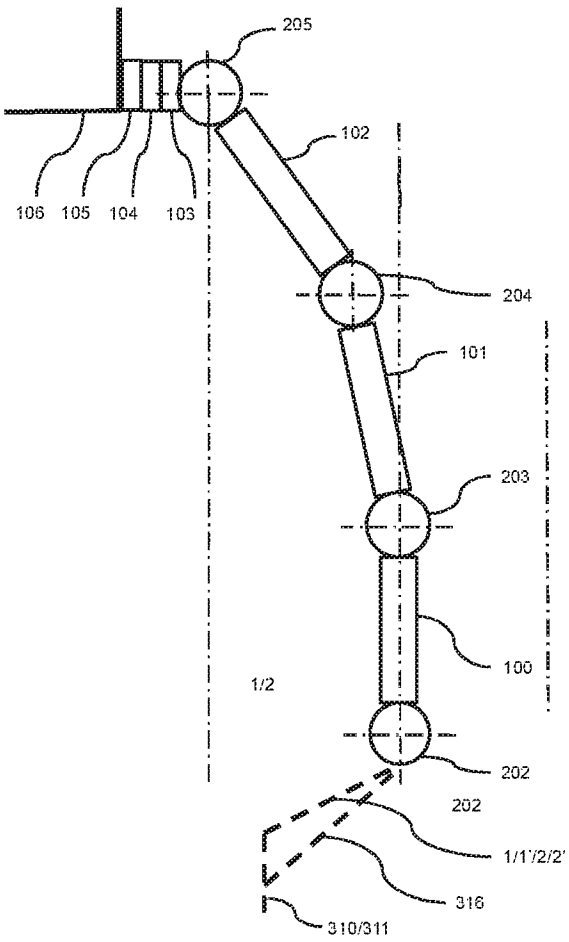
Figure 3E:
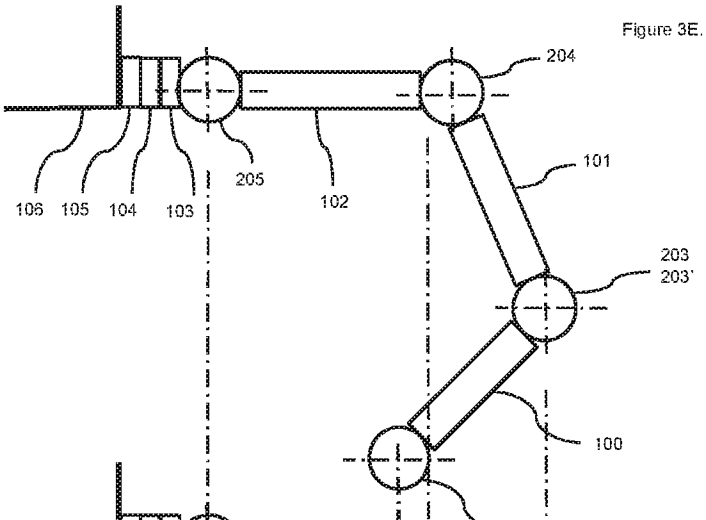
Figure 3F:
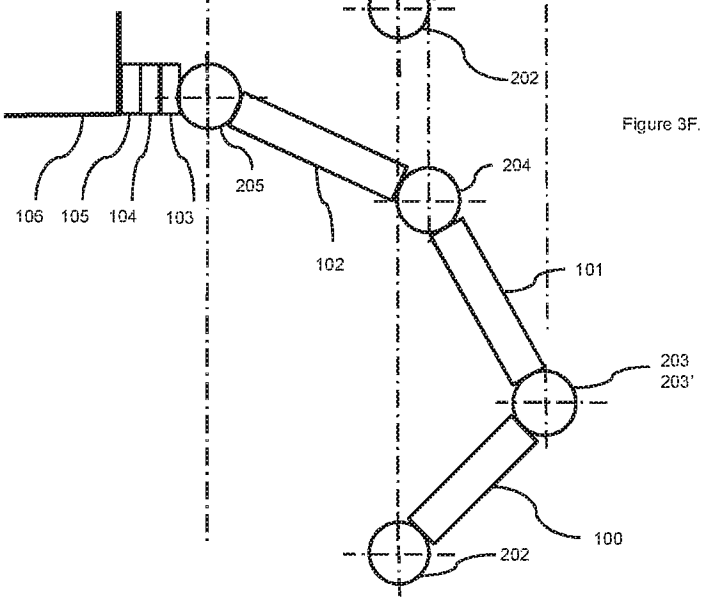
Figure 3J:
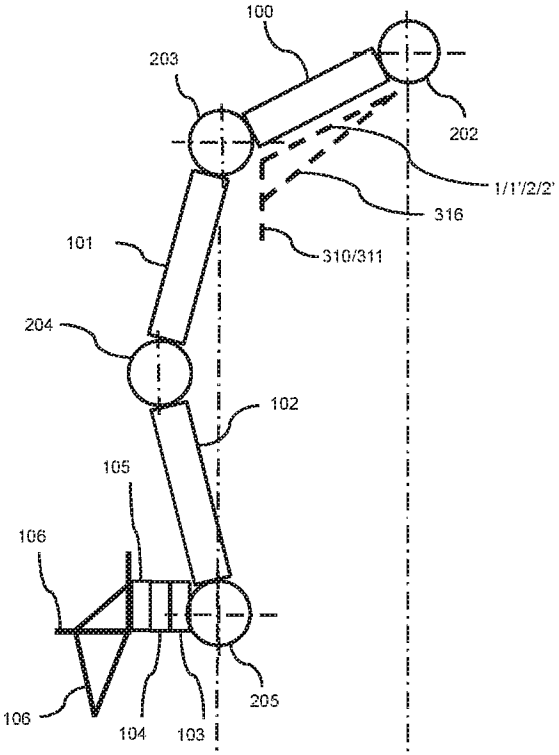
Figure 3H:
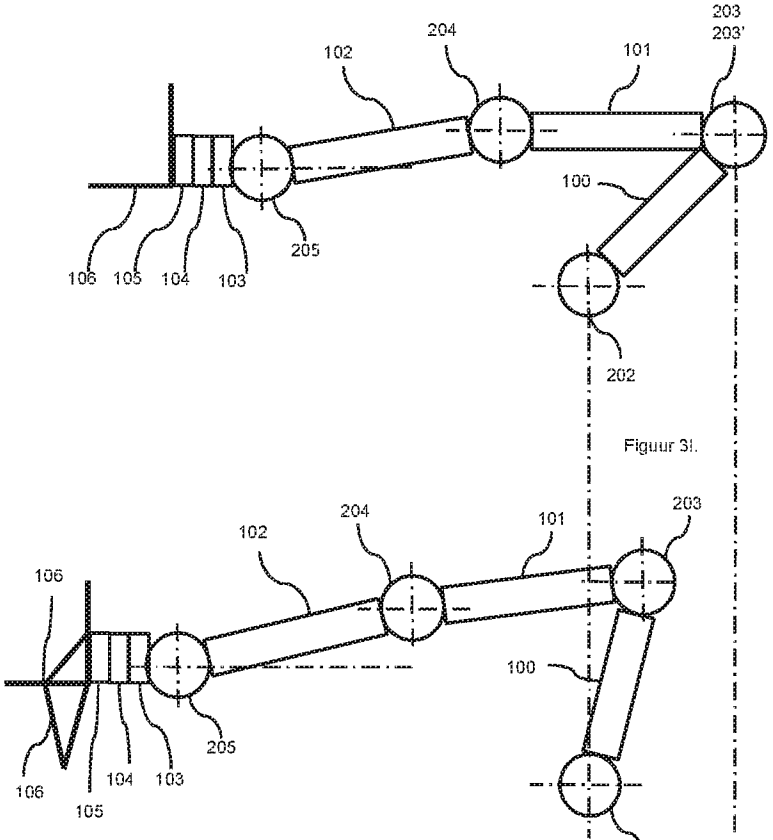
Figure 3H:
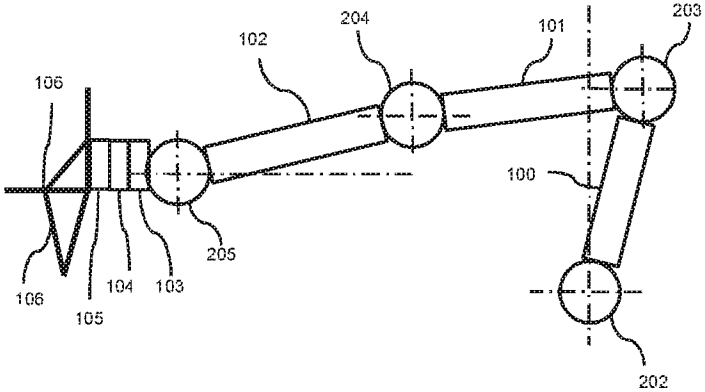
Figure 3N:
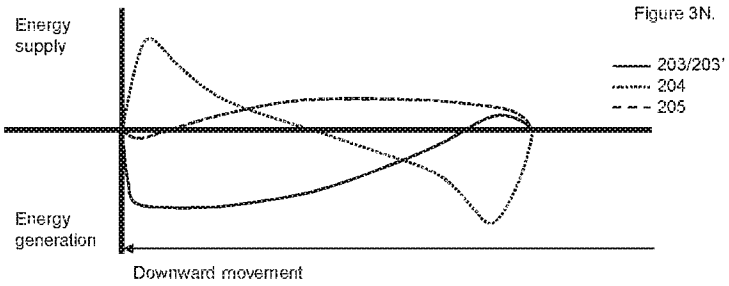
Figure 3O:
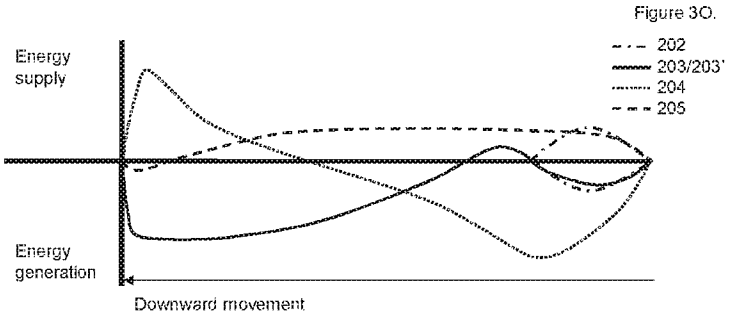
Figure 3P:
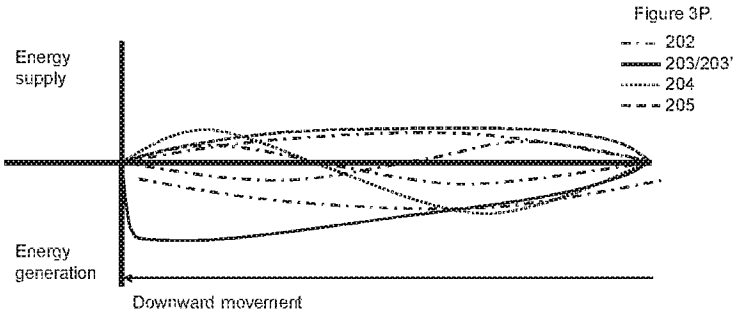
Figure 3K:
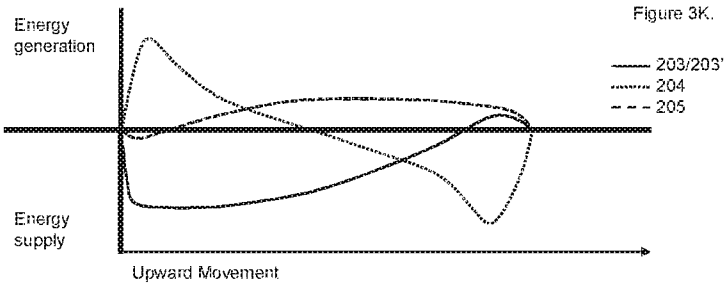
Figure 3L:
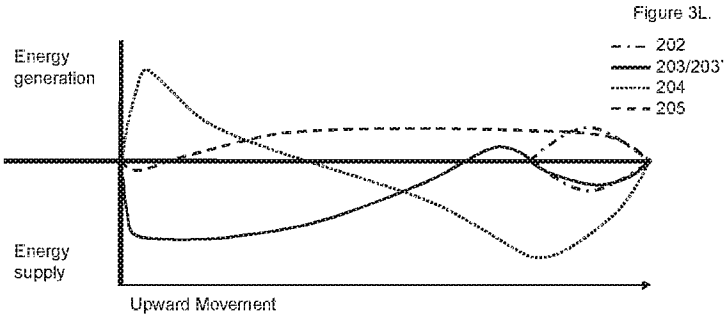
Figure 3M:
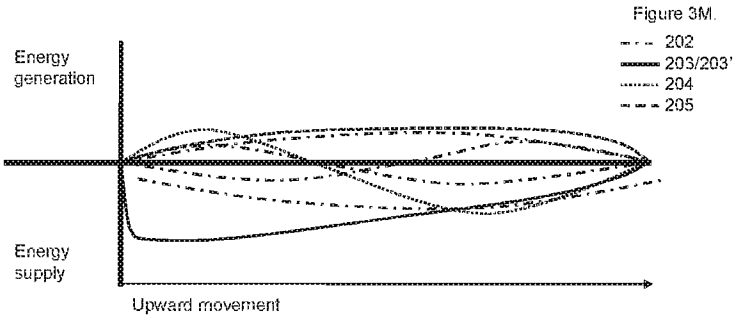
Figure 4A:
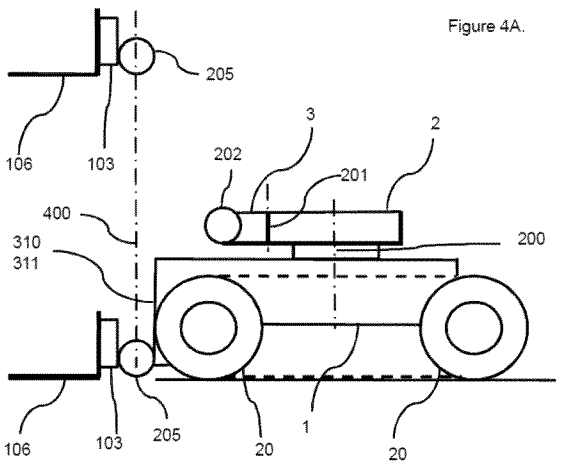
Figure 4B:
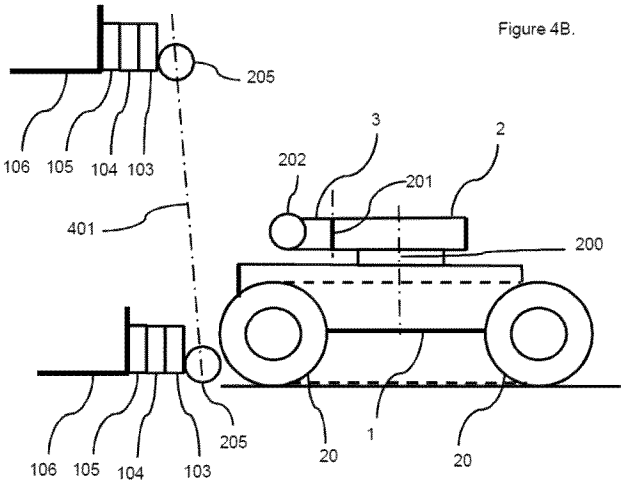
Figure 4C:
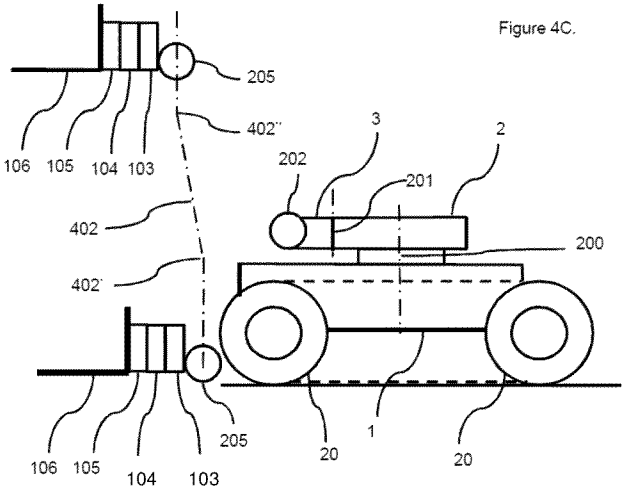
Figure 4D:
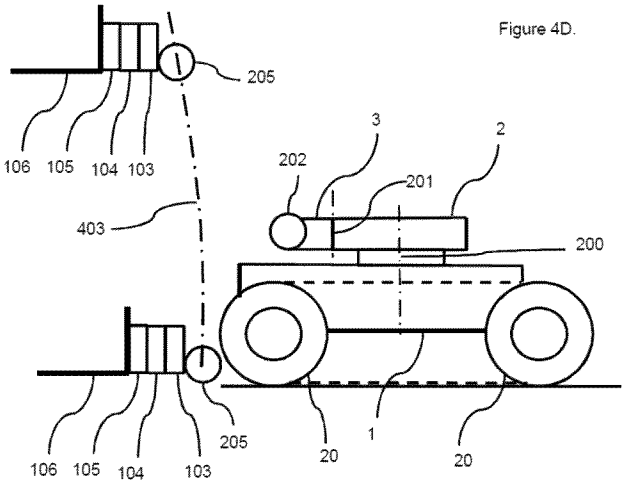
Figure 4E:
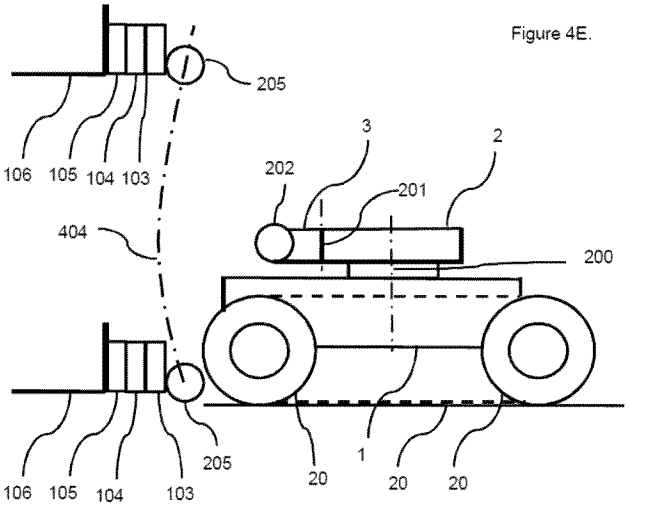
Figure 4F:
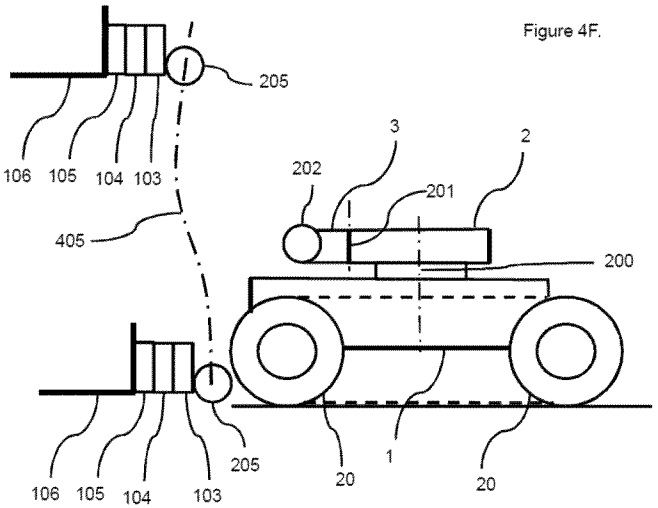
Figure 4G:
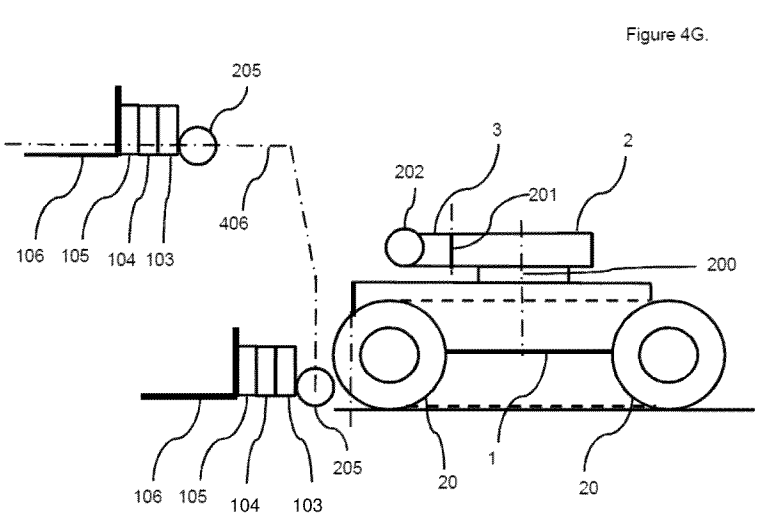
Figure 4H:
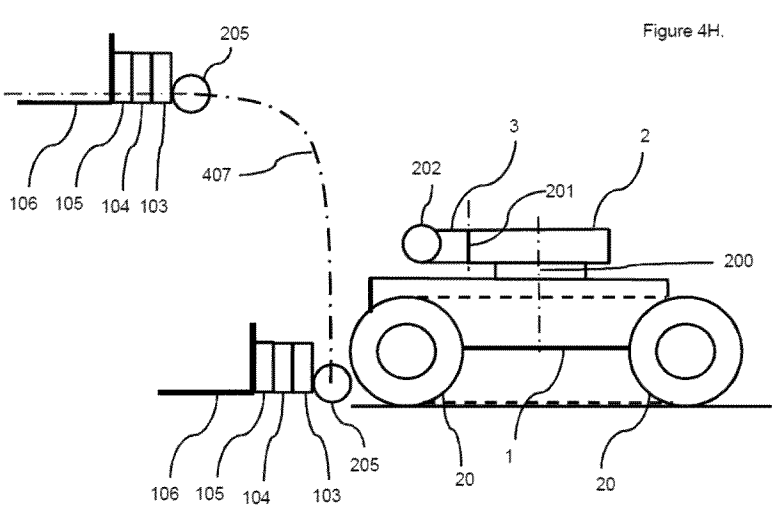

Figure 3C.
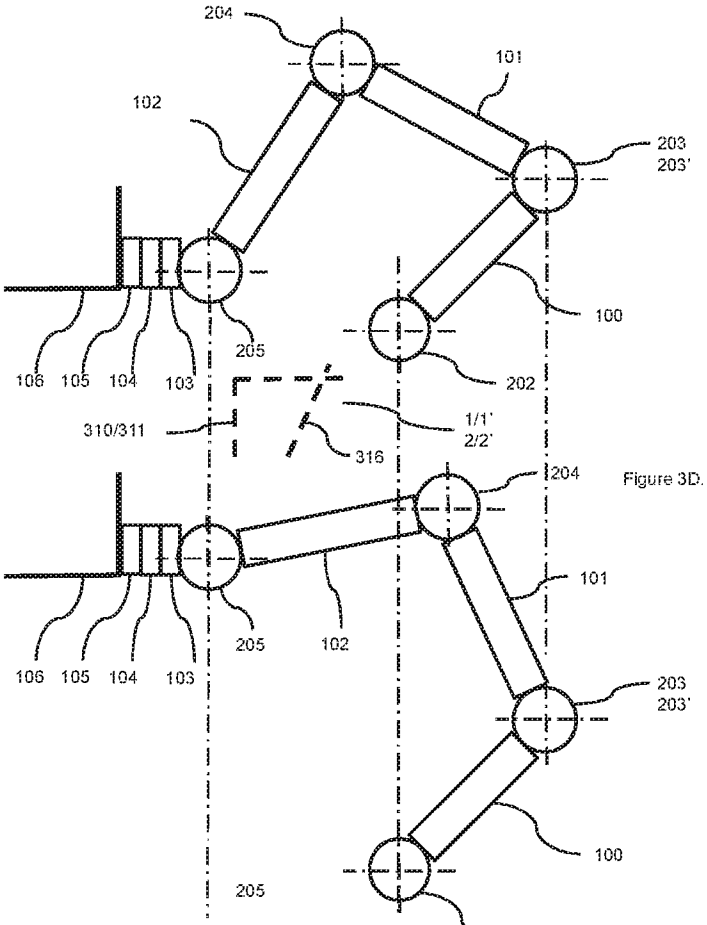
Figure 3D.
Figure 3A.
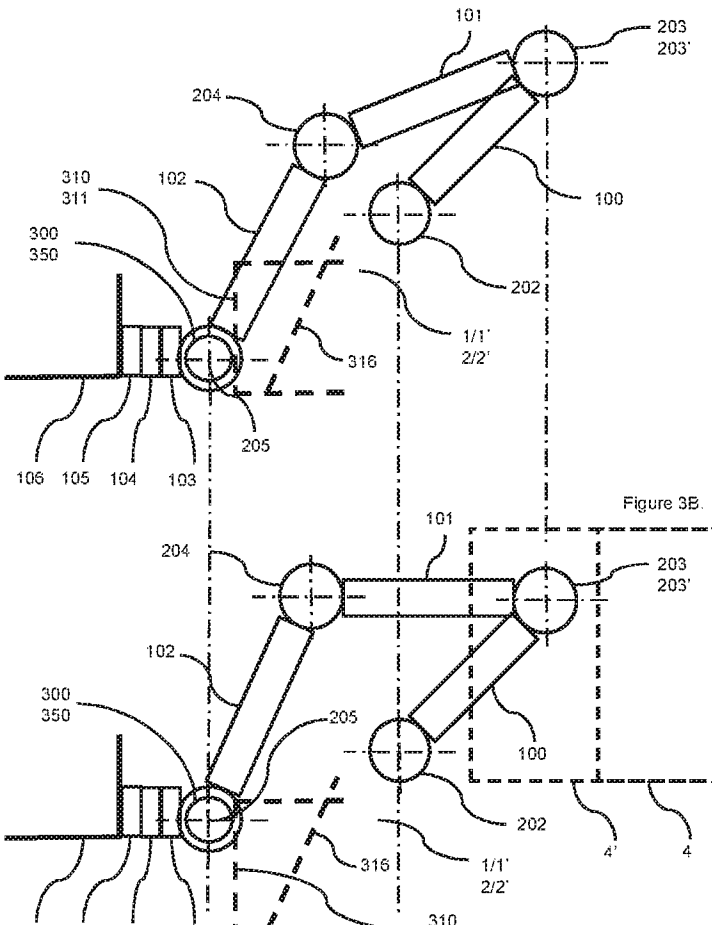
Figure 3B.

Figuur 3I.

203/203'
204
205
Energy supply
Energy generation
Downward movement 202
203/203'
204
205
Energy supply
Energy generation
Downward movement 202
203/203'
204
205
Energy supply
Energy generation
Downward movement 203/203'
204
205
Energy generation
Energy supply
Upward Movement 202
203/203'
204
205
Energy generation
Energy supply
Upward Movement 202
203/203'
204
205
Energy generation
Energy supply
Upward movement

MOBILE DEVICE

This is a national stage application filed under 35 U.S.C. § 371 of pending international application PCT/NL2020/050012, filed Jan. 10, 2020, which claims priority to Netherlands Patent Application No. NL 2022360, filed Jan. 10, 2019, the entirety of which applications are hereby incorporated by reference herein.

DISCIPLINE

The present invention relates to the field of mobile devices such as, for example, tractors with front loaders, forklifts, wheel loaders, telescopic loaders, also known as telescopic loaders, excavators, material handling machines, forestry machines, cranes, infrastructure maintenance machines, roadsides parks and garden equipment, lifts, aerial platforms, fast travelling work machines and combinations thereof.

BACKGROUND

Known prior art is characterized by forklift trucks with a vertical or almost vertical movement. Wheel loaders or front loaders have a radial lifting movement. Compact loading shovels, also known as skid steer loaders, can have a radial or vertical lifting movement or almost vertical lifting movement. These types are often equipped with a tool to lift something with, for example, a pallet fork. Man lifts or aerial platforms can also have a vertical lifting movement, possibly in combination with telescopic sections. Excavators, material handling machines, forestry machines and cranes usually have a number of work arm segments sections that move radially with respect to each other and are controlled, possibly in combination with a rotation of these segments relative to a main frame or a sub-frame. These machine types all have displacement means in the form of wheels and tires or tracks. The steering can be per wheel, per set of wheels, all wheels, per axle or can be an articulated steering. These machine types may have the motor (s) and energy source (s) for the drive in a main frame or in the rotating sub-frame.

It is well known that mobile devices have computer systems, computers, processors or I/O units, ECUs or controllers. Electronic signals or bus systems are also used. There are different types such as the CAN-Open, J1939, Byteflight, D2B, VAN, and for example the Flex Ray standard.

In the prior art, these types of machines also use measuring instruments, so-called sensors, to measure positions of parts of the machine. These sensors can be linear to measure a linear distance. They can also measure rotations for the angular rotation or accelerations of a part of a machine, for example an arm relative to the platform or a ground level/horizon or, for example, an articulation relative to another articulation. Measuring the angle or orientation between the mobile device and the ground level or the horizon is also possible.

SUMMARY OF THE INVENTION

State-of-the-art machine platforms often have a specific main task, they are designed to lift radially or vertically or almost vertically to the greatest possible height or to push or move them in the horizontal direction, possibly with a telescopic articulation. Or they are designed to move a tool or move an object or material in 2-dimensional or 3-dimensional planes with multiple radial movements of arm segments in a plurality of directions, possibly also with telescopic sections. The lift-oriented platforms keep the load close to the platform during the lift path, so that a relatively large mass can be lifted, while a platform with multiple arm segments must be able to bridge as far as possible a stretch and thereby a large horizontal distance or depth. The present invention combines these two functionalities through a special kinematic solution and control thereof. The second inventive aspect is the guidance of the articulated or coupled tools or load during the movement of an ascending or descending path. The third inventive aspect is the recovery of energy from the radial movement of a section or a combination of radial movements.

Embodiments of the invention relate to platforms with functions such as a forklift, also the type that can be taken on or behind a truck or the types used in logistics sectors with lateral adjustment for in between aisles. It relates to wheel loaders, excavators, skid steer loaders, material handling machines, forestry machines, automated guided vehicles (AGVs), aerial work platforms, mower-arm machines, cranes and all machine types that have a lift, stretch or dig function. These can also be autonomous vehicles (AV) or robot vehicles. These platforms can have a so-called sensor suite such as cameras (CMOS), thermal cameras, infrared (FIR), ultrasonic sensors, radar, lidar and so on.

The features of embodiments of the invention described below can be combined in any way, and the invention is by no means limited to specific features or embodiments described below.

An embodiment of the invention comprises a frame (1, 2) with displacement means (20) and has a working arm (50) connected to the frame and comprises at least a first (101) and a second articulation (102) hinged to each other. It has at least a first, second and third control device adapted to move the first and second articulation of the working arm, respectively, and a tool (106) at a free end of the second articulation, a control system adapted to control the first, second and optionally the third control, the first articulation (101) being pivotally connected to the frame. A feature is that the control system is adapted to control the first, second and third control members such that the free end of the second articulation (102) follows a predetermined upward movement along an upwardly directed path and the tool remains in a lifting position, wherein the first, second and third control members are controlled simultaneously.

The mobile device has at the end of the second articulation (102) a tool (106) or a quick coupler system (103) or a pivot and/or tilting joint (104) or an adapter (105) or a hinge structure or a combination thereof coupled so that a third control member is coupled to the quick-change system or to the tilting joint or to the hinge structure or to the tool. A quick change system is a component to which tools can be connected to a section of a machine, for example of a Lehnhoff or Oilquick type. A rotary and/or tilting joint is used to position a tool or a load or a quick-change system or an adapter in different directions. This can be in a single direction, but also in multiple directions. Manufacturers of so-called rotors, or pivot pieces or swivel and/or tilt joints are, for example, Tiltrotator, Engcon and HKS. However, it may also be joints of a different type to realize angular rotations in several directions. An adapter ensures the coupling of different dimensions of tools with a section, or with a quick-change system or with a rotation and/or tilting joint. An adapter can also be understood to mean a second quick-change system between, for example, a turning and/or tilting joint and a tool. A tool can take many forms. A number of examples are: pallet fork, loading shovel bucket, digger bucket, milling machine, mower, lift platform or bucket for people, snow blade, snow thrower, extension for articulation, seed drill, plow, push blade, extractor. And many tools that are used in the branches described.

A hinge structure for moving a tool (106), a quick-change system (103) or a pivot and/or tilting joint (104) or an adapter (105) can be a direct movement of a control member such as a motor or spindle or cylinder. It can also have a different shape, such as a parallelogram, in which a control member realizes the movement of the tool (106), a quick-change system (103) or a swivel and/or tilting joint (104) or an adapter, via a plurality of mechanical parts and pivot points (105).

A characteristic of the mobile device is that the upwardly directed path deviates less than 20° from a vertical path. This can be a linear path, or a path with one or more kinks or one or more curves. The upwardly directed path can partially run almost vertically.

The control system adapted to control the first, second and third control means, the first articulation (101) being pivotally connected to the frame may have a control system for controlling the first, second and optionally the third control means such that the free end of the second articulation (102) makes a predetermined substantially horizontal movement along a substantially horizontally oriented path and the tool remains in a lifting position, the first, second and third control members being controlled simultaneously. The horizontal path may, for example, make an angle equal to or less than 20° to the horizontal, preferably less than 5° to the horizontal.

The upward path can be such that the tool is more forward in relation to the frame in an end position than in an initial position. The foregoing is intended to be further away from the mobile device. The upwardly directed path can also make an angle with a vertical path, increasing the angle between a starting point and an end point of the path. The upward movement can also follow a slant from the lower position to the upper position. The upwardly directed path may also comprise a curved part or a combination of a straight part and a slanted part and/or a curved part and/or a horizontal part.

The upward movement of the end (205) of the second articulation (102) can follow a path starting in the lower position with a vertical part, then a slanted forward or curved forward part or a combination of slanted and curved, so that the upper position is the end of the second articulation (102) or the tool (106) farther forward than in the lower position. The path can also follow a part between the lower and upper position, this part lying more to the front and the other parts more to the back. This can increase the lifting capacity.

The control system can be adapted to control the first, second and third control means, wherein the first articulation (101) is pivotally connected to the frame and the control system is adapted to control the first, second and third control means such that the free end of the second articulation (102) performs a predetermined downward movement along a downward directional path follows and the tool remains in a lifting position, the first, second and third control members being controlled simultaneously.

A downward directed can be substantially identical to the upwardly directed path. An embodiment may also be that a downward path follows a different path than the upward path.

Both the up and down paths can be started after a command via a driver control device. This can be from a lower or upper starting position, but it can also be triggered during a random movement of the sections. The upward and downward path can be started near the frame or main frame, but it can also be further away. The positioning of the frame relative to the main frame can be straight, but it can also have an arbitrary angle to use the path. This also applies to the horizontal stretching movement. The command for an up, down or horizontal path can be used by the control system, or can be done autonomously or with a wireless connection.

The control system can be adapted to adjust the position of the tool relative to the second articulation during the predetermined upward movement, such that the tool performs a substantially vertical translation movement. The tool (106) is then automatically held in the same position with respect to the frame during the course of the end of the second articulation from a lower position to an upper position or from an upper position to a lower position. The tool (106) can also be automatically held in the same position with respect to the frame during the course of the end of the second articulation which makes a horizontal or substantially horizontal translation movement.

While following the previously known movement of the end of the second articulation from the lower position to the upper position, the angle between the frame and the first articulation (101) increases and then decreases while the angle between the first articulation (101) and the second section (102) first decreases and then increases.

While following the previously known movement of the end of the second articulation from the upper position to the lower position, the angle between the frame and the first articulation (101) first increases then and decreases, while the angle between the first articulation (101) and the second section (102) first decreases and then increases.

An embodiment is possible in which a frame (2) is rotatable on a main frame (1) via a pivot point (200). The hinged connection between the frame and the first articulation allows a rotation of the first articulation about a horizontal axis. The hinged connection between the frame and the first articulation can also allow a rotation of the first articulation about a vertical axis. The pivot point (202) between the frame (2) and the first articulation (101) and the frame (2) can also allow a lateral adjustment (3) with pivot point (201) with a vertical or substantially vertical axis. A double lateral adjustment is also possible, wherein the end of at least one articulation or the quick-coupler system or tool is again positioned parallel to the transverse direction of the mobile device.

An embodiment has an additional articulation (100) between the frame (2) or a lateral adjustment (3) and the first articulation (101) through pivot points (201 and 203"). The additional articulation (100) is controlled by a control member during the movement of the tool (106), a quick coupler system (103) or a pivot and/or tilting joint (104) or an adapter (105), optionally with an upward movement thereof. The additional articulation (100) can be controlled by a control member during the movement of the first articulation (101) and optionally the second articulation (102), so that the end of the last articulation (205) can reach a greater height than without this additional articulation section.

The additional articulation (100) is controlled by a control means so that the end of the last articulation (205) can extend further from the frame (2), optionally during the control of the first articulation, (101) and/or the second articulation (102). A greater range and depth in the vertical sense is achieved here than without this additional articulation.

The additional articulation (100), the first articulation (101) and the second articulation (102) are controlled by control members so that at least one control member is a tool (106), a quick coupler system (103) or a pivot and/or tilt joint (104)) whether an adapter (105) or a combination can follow a horizontal movement, a diagonal movement, a vertical movement, a curved movement or a combination.

An embodiment can also have a fourth or more than four sections in total between the frame (2) and the tool (106). Articulations with a telescopic construction are also possible.

Between pivot points of articulations or between parts of a articulation a vertical or substantially vertical pivot point can also be active and this can optionally be blocked. There may be pivot points between sections and within sections in directions other than horizontal or vertical. The movement over pivot point (201) between frame (2), and the additional articulation (100) can be blocked as soon as the additional articulation (100) moves into a reclined position. Backwards means closer to or inside or above the frame (2) or main frame (1). The movement over the pivot point (200) between the main frame (1) and the frame (2) can be blocked as soon as the additional articulation (100) moves into a backward position. A driver can bring the additional articulation (100) back via control instruments or the additional articulation (100) is automatically brought back via a control system.

An embodiment can block an engagement point (250) of a control member between the frame (2) or the lateral adjustment (3) between the frame (2) and the additional articulation (100) in two or more positions. Optionally, during the blocking of this engagement point (250) of a control member in the most backward position of the additional articulation, the rotation of pivot point (201) between the frame (2) and lateral adjustment (3) and/or the rotation is also simultaneously of the pivot point (200) between the main frame (1) and the frame (2) is blocked. A further embodiment is operated manually via operating instruments or is automatically operated via a control system or a calculation unit, a controller or an ecu.

The blocking of the point of engagement of this control member can also be in combination with the blocking of the movement of this control member such as, for example, a valve (5000) or brake (2002). The control member can even be held under force or pressure in this position.

The additional articulation (100) at the end of this articulation near the pivot (203) with the second articulation or at the point of engagement (1002) on the additional articulation of the control member for this articulation (1000) can be supported against a buffer block (2A) on a part of a cabin (4/4') or on a steering column on the frame (2), with contact points of steel, plastic or other damping material optionally positioned. It is possible for the driver to be able to look over the sections to the front and to the driving surface in front. The additional section (100) can be blocked in the most reclined position.

The mobile device is comprised to move, compress or lift material, the mobile device moving with load or load and/or tool such that the force and torsion on the articulations are reduced. And the mobile device can be constructed with ratios of the articulations and control members such that a large height can be achieved, whereby the load or load is kept close to the moving means. The inventive of an embodiment of the invention is that during the movement of the load or the end of the last articulation in an upward or downward path, a guidance during this movement continues to provide support in several directions. The height of the support or guide can be less, or equal or higher than the height of the frame or main frame or can be less, equal or higher than the displacement means. The guide or support can be active on the front or rear or on both these sides of the mobile device and thus during reverse or forward driving. The guide can be in a two- or three-dimensional direction to support a tool and thereby also the sections in a reverse motion. A slender shape of the articulations for an optimal view of the driver is then combined with a robust torsion-proof articulation and support.

One or more supports (300) may have a circular or rounded shape or other shape and may be mounted or rotate about a point on one side of the last articulation (102) or on two sides of the last articulation (102). At least one support (300) may have a circular or other shape and may be mounted or rotate about the pivot point or axis on the last articulation (205) over which a quick coupler system (103) or a pivot and/or tilt joint (104)) or an adapter (105) or a tool (106) can move or rotate.

The end (205) of the last articulation (102) follows a guide, plane or line (310) or a supporting curving guide plane or line (311) or a combination thereof on a frame via a shaft (205) or support (300). (2) or main frame (1) or a moving part thereof during the movement of the end of the second articulation (205) from a lower position upwards or from above to a lower position, optionally the articulations driven about the movement path and the guide to follow.

The sections and thereby also the last section can be positioned from the center of the mobile. The articulation (310, 310 ", 311, 311") can also be used during a lateral adjustment of the last articulation. This can be achieved by a lateral adjustment of a turning and/or tilting joint on the last section in the event of a possible rotation of the frame on the main frame or in the case of a rotation of the frame on the main frame in combination with the control of a lateral adjustment (3). It may also be that a double lateral adjustment brings the tool parallel to the transverse direction of the mobile device.

An axis (205) or a support (300) on a second side in the horizontal direction is supported by an additional guide surface or line (310') or an additional curved guide or line (311') or a combination thereof, optionally on a part coupled to the frame (2) or to the main frame (1).

An additional guide, plane or line (310') or an extra curved articulation, plane or line (311') or a combination thereof can move relative to the frame (2) or the main frame (1) or a moving part thereof, optionally the end of the last articulation (205) being able to follow these guides, lines, or planes while moving or positioning these lines or planes relative to the frame or main frame.

A support (312) can be guided laterally through a line, plane or curvature (313). At least one shaft (205) or a support (300) can be supported at the bottom in vertical direction by optionally positioning a plane or curvature or line (315) relative to the frame (2) or the main frame (1). A support (350) with a round or rounded or different shape on one side of the last section (102) and/or a second support (350) on another side of the last section (102) connected to a quick-coupler system (103) or a pivot and/or tilting joint (104) or an adapter (105) or a tool (106) can move or rotate in the same line as the pivot point (205) between the last articulation (102) and a quick-coupler system (103) or a pivot and/or tilting joint (104) or an adapter (105) or a tool (106).

A support (350) a guide, plane or line (310) or a curved guide plane or line (311) or a combination thereof follows the frame (2) or the main frame (1) during the movement of the end of the second section (205) from bottom to top or from top to bottom. The sections are optionally controlled to follow the movement path and guidance.

A support (351) is guided laterally by a lateral guide, line, plane or curved guide (352) and/or at the bottom in vertical direction can be guided by a plane or curvature or line (315).

An embodiment has a support (300, 350) that is guided by a guide, line, plane or curved guide (313) and or in combination with a guide, plane or curvature (314) so that it forms a funnel-shaped guide for the support (300, 350, 312, 351) optionally in combination with a beveled or curved guide, line or plane of the lateral support (313, 352). In this case a deviation in the positioning of the sections is absorbed by the funnel-shaped guides.

The shape of the frame (2) or main frame (1) or an extension part thereof at an underlying position of the last section (102) has a recess (316) to accommodate the last section (102) and or quick-change system (103) or a turning and/or tilting joint (104) or an adapter (105) or a tool (106) or a control member (317) of a tool on the last articulation (102).

The articulation may also have a forward-facing shape (318) so that the guide must first follow the axis (205) or a support (300, 350) for an oblique, curved or forward movement to continue the upward path.

The displacement means comprise at least one wheel or more wheels or one or more tracks or a combination, wherein the control can be per wheel or caterpillar, per axle, all wheels, all tracks, or a skid control for wheels or tracks. The displacement means can be active during the guidance or support of the shaft (205) and/or supports (300, 350). The pushing force of the displacement means can also be limited above a certain height of the upward path (402") of the end (205) of the last articulation.

A tool can be coupled to a turning and/or tilting piece and the turning and/or tilting piece can be guided and supported. There are fewer forces on the turn and/or tilting piece.

It is also possible that a guide (310, 301 ", 311, 311", 315) blocks a shaft (205) or support (300, 350) in height (320). Or that the materials of the guides or parts thereof are made of a wear-resistant, stainless or damping material. These materials can then be easily replaced. A further embodiment has spring elements in or on the guides and possibly in, for example, different directions: vertically above and below, forwards, backwards and sideways.

An application of a blocking in height is that a push blade or loading shovel bucket or snow blade is coupled as a tool. The height can be the block can be in steps or stepless. The height can, for example, also be blocked after the mobile device has lifted itself for transport on, for example, the rear of a truck.

A guide can also be adjacent or integrated into a mudguard of the frame or the main frame for displacement means. An embodiment may have lines of sight (4000) running between, beside, or over the moving means so that a clear view from the driver is possible from the lower part of the ascending path to the upper part.

A control member can be mechanical, electrical, hydraulic, pneumatic or a combination thereof. A controller may be a hydraulic cylinder, or a hydraulic motor, or an electric motor (2000), or an electric spindle or an electric solenoid, or a pneumatic cylinder, or a pneumatic motor, optionally with a transmission such as a gear transmission or a chain or a or a combination thereof.

A spindle can have the motor near the spindle or mounted directly on the spindle, leaving room around or in the articulation for these components.

A transmission can include at least one of the following types: planetary system (2003), or a gearbox (2003), or a Strain Wave Gear (Harmonic Drive) type (2004), or a Wittenstein Galaxie type (2004), or of a cycloid type transmission (2004) or another transmission with a large to very large transmission ratio, or a multi-switched transmission, or a transmission in a transmission (2003). Other transmission types may also be effective.

A brake (2002) may be provided to stop or block the movement of at least one articulation such as a drum brake, or a disc brake, or a toothed brake, or integrated into a controller or into a transmission. The steering system can operate the brake while initiating an up or down path.

A brake can be integrated in the control member or next to the control member or directly coupled to the control member or to a control member such as a motor, so that the required braking force via a transmission need be less. The brake can be mechanically, hydraulically, pneumatically or electrically operated, also via the steering system.

A controller or a transmission or a brake can be large in diameter and relatively narrow with at least a ratio of 2 of diameter to 1 of width or depth. This makes slender sections, with the sight lines (4000) being better for the driver.

The inventive step is that energy can be recovered from the rotation of at least one section.

A control device of a hydraulic or pneumatic type can store the energy in a medium, a liquid or a gas under pressure in an accumulator and then release it again as soon as energy is again required from this control device. An embodiment is possible in which the energy is recovered under pressure without the intervention of an accumulator and is directly supplied to another control member with one or more valves.

A controller of a hydraulic or pneumatic type can convert the energy via a pump (P) into a rotating movement, an electric motor/generator (M/G) taking the energy and feeding it to an electric energy storage unit. The control system can control one or more valves (5000) with the option of a single pump for multiple control members from multiple sections.

A controller of an electric motor/generator or spindle or electric solenoid can absorb the electrical energy itself and feed it to an electrical energy storage unit.

It is also possible that each section can separately recover the energy via one or more controllers.

Energy can be recovered in the upward path, the downward path and also during a horizontal movement. Gravity is responsible for this recovery. For the first articulation (101) and second articulation (102) and the tool, the load and the own weight of the parts provide predictable recovery in an up and down path. For the additional articulation (100) this depends on the position of this articulation, the mass of this articulation and the mass of the load. The proportions of the lengths of the sections can also determine the orientation of the recovery. A number of examples are indicated in the figures.

A section with control may have a controller or ECU, optionally with an inverter or converter or rectifier, or transformer so that energy is supplied to the control or, conversely, recovered. A computer unit or a control system controls the energy flow direction to and from the controller. Optionally this is based on control instruments.

There may also be an embodiment in which two or more control members are and one control member for one articulation uses energy and another control member for another articulation recovers energy simultaneously. Optional is that wherein the first articulation (101) moves down and generates energy through a controller and simultaneously moves the last articulation (102) out or forwards and uses energy, or at the same time the last articulation (102) also moves down and in moves and also supplies energy.

The first section (101) can also move upwards and consume energy and at the same time move the last section (102) inwards and supply energy.

The first articulation (101) or the last articulation (102) can move up and consume energy and a control device for controlling the tool (106), or a quick change system (103) or a pivot and/or tilt joint (104) or an adapter (105) supplies energy.

A control member can be provided with a separate hydraulic or pneumatic pump and this pump is driven by a separate electric motor/generator, which is then only controlled when energy is required or energy is recovered. This is optionally based on the operation of control instruments or of a control system or of a computer unit or controller or ECU and it can also be optionally equipped with one or more valves.

There may also be an embodiment with a first joint pump for two or more controllers of different sections for the energy supply to these controllers and that there is a second joint pump for energy return of these two or more controllers, which both pumps are controlled by a control system, or a calculation unit or a controller or an ECU, optionally via one or more valves. This reduces the number of pumps.

The control of one or more valves or braking systems can be deployed simultaneously with the control of at least one control member both during an energy supply or energy recovery movement of a section or a tool (106) or a quick-coupler system (103) or a turning and/or tilting piece (104) or an adapter (105). This is optional with the control of an electric motor or a hydraulic motor or a hydraulic or pneumatic pump.

Two or more control members can be active per section and two or more sections can be active for the same movement. In the latter case, two sections form a symmetrical section structure.

The movements of the mobile device and the at least one or all sections thereof can be programmed. In addition, this can be continuously changed and/or controlled by a computer unit or control system. Optionally, this is possible through artificial intelligence.

The movement of the mobile device can be programmed, or is controlled by a driver via control instruments, optionally with haptic feedback.

Operating instruments can be: one or more virtual reality gloves, one or more joysticks, one or more buttons, one or more sliders or rollers, one or more touch-screen displays, a virtual-reality glasses, a camera, a laser pointer, one or multiple body movement sensors, a voice command or a combination thereof. These can serve as input for a computer unit or control system, which can be equipped with artificial intelligence to learn movements of the mobile device and/or sections and then perform more intelligent, efficient and energy-efficient, optionally with an instrument for an up or down movement or a horizontal or substantially horizontal movement of the end of the last section (102).

The control system can control the required controls for an up or down path or also for a horizontal path in such a way that the controls or possibly in combination with pumps only provide the required energy when needed at that point in the path. A rapid acceleration of the controls and/or motors is then required. This is possible, for example, with electric motors due to the high starting torque. It ensures less energy consumption and less noise. Examples of the required energy balance per rotation of the sections are shown in the figures.

Control devices can be equipped with cooling systems. This can be air cooling, but also liquid cooling. To this end, hoses and pipes to the control members can also run on or in the sections. For example, electric motors in the sections can be cooled with this.

The control of the sections can be done manually by the driver or by a control system with one or more calculation units or processors, or ECUs or I/O units or a combination and with for example a bus system of different types such as CAN, CAN-Open, J1939, Byteflight, D2B, VAN, or a Flex Ray. Other faster electronic and/or digital communication between components is also possible.

A further embodiment has a pivot point (204) of the second articulation (102) that coincides with a pivot point or engagement point of a control member, optionally the control member to move the first articulation (101).

An embodiment is possible in which the first articulation (101) has a length between a first pivot point (203/203') and a second pivot point (204) with a value between 80% and 100% of the value of the length of the second articulation (102) between a first pivot point (204) and the end of this articulation (205), optionally wherein the ratio of the lengths is 90% with a deviation of up to 2%.

An additional articulation (100) has a length between a first articulation point (202) and a second articulation point (203/203') with a value that is at least 90% of the value of the length of the first articulation (101) between an first pivot point (203/203') and a second pivot point (204). Optionally, the values are 100% equal with a deviation of a maximum of 2%.

An embodiment is that a control member in the extreme positions of the control member for moving one articulation (101) has exactly the same dimensions as at least one other control member in the same extreme positions of this control member for moving another articulation (102). Optionally, they also have exactly the same dimensions as a controller in the extreme positions for moving a parallelogram or tool (106) or a quick-coupler system (103) or a pivot and/or tilting joint (104) or an adapter (105) or a combination thereof. Further optional is that at least three exactly the same control members operate with a possibility of deviating from these dimensions of these control members by a maximum of 2%.

A fourth control member is possible with in the extreme positions of this control member for moving the additional articulation (100) and having exactly the same dimensions as at least one other control member, optionally with a deviation of at most 2%.

A control member in the form of a cylinder can have a stroke (extended length minus the installation length) of approximately 60% of the retracted installation length, preferably 58% with a maximum of 1% deviation.

Two or more control members can generate the same control force. Optionally, wherein the control member for moving a parallelogram or tool (106) or a quick-change system (103) or a pivot and/or tilting joint (104) or an adapter (105) generates less control force in one or more directions than at least at least one other control member, while the control members have the same dimensions.

Three or more controls may have the same locations on the control for pipes or hoses or cables or valves, or controllers, or an ECU or solenoids or a combination, optionally four controls.

A pivot point between two sections can have two or more bearing bushes and the pin through the bearing bushes is also the line of the pin or the pin itself for the pivot point or engagement point of at least one or more control members. Optional is the pivot point between the first (101) and the second articulation (102).

The bearing bushes and the surrounding material for holding the shafts or pins of the control members and optionally holding shafts or pins of articulated pivot points may have the same diameter as a point of engagement or eye of a control member or spindle or cylinder so as to pass longitudinal hoses or damage cables or optical fibers.

At least two pins that are part of different pivot points can have exactly the same dimensions and optionally at least three pins with exactly the same dimensions for three different pivot points.

Two sections can abut against each other and support each other in a backward position of the section, preferably the one closest to or connected to the main frame or frame such as, for example, the additional section (100). Optional are the points of support between the sections of a metal or a pressure-absorbing material such as rubber or plastic.

The main frame (1) or frame (2) has a location or cabin (4, 4') for a driver, this location being oriented next to or behind one or more sections, optionally a seat in the cabin (4, 4') before a driver can be shifted sideways.

The main frame (1) or frame (2) can comprise a tunnel towards the sections, through which pipes, hoses and cables run to the sections.

The main frame (1) or frame (2) comprises a floor or floor for a driver, the floor or floor having an inclined surface at the height of the driver's feet, creating a space under this inclined surface for technical components such as hoses, lines, cables, valves, an energy storage unit or a motor, optionally a rotary motor for the rotation between the frame and the main frame.

An embodiment is possible in which the pressure of a liquid or gas or the amperage and/or voltage in a control device is measured by a sensor and thereby fed to a control system or control system for measuring the mass of a charge, which is lifted by the sections, optionally by the control system or steering system to indicate maximum height or scope of this load by the control system to the driver.

At least one or more sections or one or more control elements may contain a linear, accelerator, gyroscope, rotation, angle, encoder, rotation vector, gravity sensor, camera, fiber optic, photonic integrated circuit based fiber type sensor sensing) or a combination thereof to follow the movement of the articulation and/or the control device. All sections or controls preferably have a sensor. Examples of linear sensors are from MTS and Balluff, which can also be mounted in a piston rod of a cylinder. A camera can, for example, be an optical camera.

The optical fiber (fiber sensing) can be positioned on the articulations such that the measurement locations thereof measure on fixed parts of the articulations and are not variable in bending over pivot points.

It is possible that on or in the articulations and/or the tool (106) and/or a quick-change system (103) and/or a turntable joint (104) and/or an adapter (105) or a combination thereof, a glass fiber, an optical fiber (photonic integrated circuit based fiber sensing) or a combination thereof is positioned to follow the movement of the articulation and optionally connected parts.

At or in the frame, the main frame or the pivot point between the frame and the main frame and/or a rotatable connecting piece between a frame and a section can contain a sensor of the type linear, accelerator, gyroscope, rotation, angle, camera, encoder, a glass fiber, an optical fiber (photonic integrated circuit based fiber sensing) or a combination thereof to measure the movement of at least one of these parts.

At least three or more control members or three or more sections preferably have the same sensor in type and dimensions, optionally that the sensors have the same mounting and integration in the control system.

A control system comprises a computer unit or computer unit or processor or an ECU and controls a movement path from the end of the last section via a control member (102) or the tool (106) or a quick-change system (103) or a swivel and/or tilting joint (104) or an adapter (105) through data entered via control instruments. Optional is that in which moving the end of the first articulation (101) via a control member or moving the end of the additional articulation (100) via a control member. Preferably the control system controls all relevant controls.

A calculation unit or control system compares the measurement values of at least one sensor with the measurement values that are needed from that sensor to realize that movement path and wherein the calculation unit or control system controls the controller so that the sensor realizes the intended value with a bandwidth of a deviation. Optional via a CAN, CAN-Open, J1939, Byteflight, D2B, VAN, or a Flex Ray bus.

A control system or calculation unit or a data storage unit has coordinates for sections in different dimensions and can thereby control drivers to arrive at these coordinates.

A calculation unit or control system has these coordinates carried out in a two-dimensional plane by the control members, optionally in a three-dimensional space.

The coordinates are points in a two-dimensional plane or three-dimensional space, along which a path follows for an end of at least one articulation or a tool (106) or a quick-coupler system (103) or a pivot and/or tilt joint (104) or an adapter (105) or a combination thereof and that optionally the coordinates are in a matrix. The same applies to all sections and possibly also the steering bodies.

According to an embodiment, the coordinates have a mutual distance of less than a millimeter, a millimeter or more, more than 10 mm, more than 100 mm or more than 1000 mm and that optionally the calculation unit itself calculates intermediate coordinate values.

An embodiment is possible in which coordinates are entered via operating instruments or a data carrier and that the driver is on or in the mobile device or beyond. Optionally, it is possible that the coordinates are wirelessly controlled at the mobile device.

During the movement of one or more sections, a tool (106) or a quick-change system (103) or a pivot and/or tilting joint (104) or an adapter (105) or a combination thereof is held parallel to the main frame or frame or with respect to a signal from a spirit level instrument.

An embodiment is possible in which a sensor gives a measured value and the calculation unit or control system compares this with the intended measurement value of an entered coordinate and then the at least one calculation unit or control system controls a controller to reduce the deviation from the measurement value, optionally until it matches with a possible deviation entered by the driver.

The speed of movement, via a control member, of at least one articulation (100, 101, 102) or of a tool (106) or a quick-change system (103) or a turning and/or tilting joint (104) or an adapter (105) is controlled by the computer or the control system to limit the energy required or, for example, the flow of a pump. Preferably that is for two or more sections.

The speed of movement during the course of the path via coordinates is controlled by a calculation unit or control system, optionally the start of an ascending lift path being slow, the middle part faster and the end part the more up again, again slower.

An articulation (101, 100) can have an embodiment with a cavity in which a control member can act for the movement of this articulation, optionally a control member with an integrated or mounted motor or valve At least one articulation (100, 101) may have a cavity in which a control member for the movement of this articulation may be operative, optionally an internal wall or plate (100A, 101A). An additional reinforcement may also be provided in the form of, for example, a set plate (101B) in the top left and right sides of the first section (101).

Parts or walls of the sections may have openings for parts of other sections or parts of a control member or components mounted thereon.

An articulation (101) consists of a structure of at least three walls, or four or more walls, which consists of at least one plate or more plates with multiple settlements or consists of a structure with a cross-section with a circular or elliptical shape or at least at least one square or trapezoidal shape or two trapezoidal shapes, optionally with known angles due to two additional settings per angle.

The rounded corners of a section in cross section give the driver a better view from different positions.

An advantageous embodiment of the additional articulation (100) consists of a structure with at least three walls, or four or more walls, wherein at least two points of engagement of two control members are positioned and in which pipes, hoses or electrical or electronic cables are located next to a control member for control of the articulation (100) are optionally positioned with the conduits, hoses and cables positioned below, above or along or behind a second control member, which control member controls a different articulation.

With at least the second articulation (102), pipes, hoses or cables (1035/1045/1055) can move down against a smooth side wall (102B) of a wear-resistant smooth material during the rotation of this articulation.

The latter articulation (102) has, in one embodiment, a cross-section of a circular or elliptical shape or at least one square or trapezoidal shape or two trapezoidal shapes, optionally with known angles by two additional settlements per corner.

A point of engagement of a control member on a main frame (1) or on a frame (2) or on a lateral adjustment (3) for controlling the third section (100) can be moved. Optionally, via a pivot point which is the same as the pivot point (202) of the additional articulation (100) on the main frame (1) or on the frame (2) or on a lateral adjustment (3) and the engagement point being partially inside the width of a part of the additional section (100) falls.

An engagement point of the control member of the additional articulation (100) consists of a component (500) or two plates (501) which protrude downward through the lateral adjustment (3) during displacement or rotation and thereby insert this component or these two plates abut a recess or against at least one wall of the main frame (1) and thereby a block for the rotation (201) of the lateral adjustment (3) and/or a block for the rotation (200) between the frame (2) and the main frame (1) forms.

A computer unit or control system controls the control members of the articulations, the articulations coming into a position where the point of contact of the control member for the additional articulation (100) on the main frame (1) or on the frame (2) or on the lateral adjustment (3) can move freely and after which the calculating unit or control system controls the controls and the sections so that said engagement point is positioned in a different position, whereby it can be locked, optionally such that the end of the last section (205) and the support (300/350) is held in a guide (310/310'/311/311'/313/313'/314/314'/315) during the control of the control members and sections.

An embodiment is also possible in which the additional articulation (100) forms a structure of a blocking of the rotation between the frame and the main frame and a blocking of the lateral adjustment in a backward position.

Hydraulic or pneumatic hoses or lines or electrical or electronic cables can be guided through the sections or run above a part of a structure of the first section (101), which section lies directly above a control member in this section, optionally under another control member between the first section (101) and the last section (102).

Hydraulic or pneumatic hoses or lines or electrical or electronic cables preferably run along longitudinal pivot point (204) between the first and the second articulation then run through an opening in the second articulation (102) at the rear of this articulation and come out for a control member (1040) of a tool (317) on the rear of the second section.

A motor for the rotation of the frame (2) relative to the main frame (1) can be positioned between a pivot point of an articulation on the frame and a location of a driver, optionally for the location of the driver's feet.

An electric motor or a hydraulic motor or pump or pneumatic pump or motor or hydraulic or pneumatic valve may be positioned obliquely behind or under a driver's seat on the frame.

An embodiment of an articulated control device or of a tool (106) or a quick-coupler system (103) or a turntable joint (104) or an adapter (105) can develop a greater force on one movement side than on the other movement side. Optional is a control in the form of a cylinder or an electric spindle or electric motor.

Embodiments of the invention can optionally have one or more of the following features:

- A lateral adjustment (3) with pivot point (201) with vertical or substantially vertical axis can also be active between the pivot point (202) between frame (2) and the first articulation (101) and the frame (2).
- An additional articulation (100) forms a connection between the frame (2) or a lateral adjustment (3) and the first articulation (101) through pivot points (201 and 203").
- The additional articulation (100) is controlled by a control member during the movement of the tool (106), a quick-coupler system (103) or a turning and/or tilting joint (104) or an adapter (105), optionally with an upward movement thereof.
- The additional articulation (100), the first articulation (101) and the second articulation (102) are controlled by control members so that at least one control member is a tool (106), a quick-coupler system (103) or a pivot and/or tilt joint (104) or an adapter (105) or a combination can follow a horizontal movement, a diagonal movement, a vertical movement, a curved movement, or a combination.

In total, a fourth or more than four sections form the connection between the frame (2) and the tool (106).

Between pivot points of sections or between parts of a section a vertical or almost vertical pivot point can also be active and can optionally be blocked; there may be pivot points between sections and inside sections in directions other than horizontal or vertical.

A driver brings the additional section (100) back via control instruments.

The additional section (100) is automatically brought back via a control system.

The point of engagement (250) of a control member between the frame (2) or the lateral adjustment (3) between the frame (2) and the additional articulation (100) can be blocked in two or more positions, thereby becoming optional during the blocking of this engagement point (250) of a control member in the most reclined position of the additional articulation also simultaneously the rotation of pivot point (201) between the frame (2) and lateral adjustment (3) and/or the rotation of the pivot point (200) blocked between the main frame (1) and the frame (2), optionally manually operated via control instruments or automatically controlled via a control system or a calculation unit, a controller or an ecu.

The at least one support (350) with a round or rounded or different shape on one side of the last section (102) and/or a second support (350) on another side of the last section (102) connected to a quick-coupler system (103) or a pivot and/or tilt joint (104) or an adapter (105) or a tool (106) can move or rotate in the same line as the pivot point (205) between the last articulation (102) and a quick-change system (103) or a pivot and/or tilting joint (104) or an adapter (105) or a tool (106).

The at least one support (350) a guide, plane or line (310) or a curved guide plane or line (311) or a combination thereof follows frame (2) or main frame (1) during the movement of the end of the second articulation (205) from bottom to top or top to bottom, optionally controlling the articulations to follow the motion path and guidance.

The at least one support (351) is guided laterally by a lateral guide, line, plane or curved guide (352) and/or can be guided at the bottom in a vertical direction by a plane or curve or line (315).

The at least one support (300, 350) is guided by a guide, line, plane or curved guide (313) and/or in combination with a guide, plane or curvature (314) so that it forms a funnel-shaped guide for the support (300, 350, 312, 351) optionally in combination with a beveled or curved guide, line or plane of the lateral support (313, 352).

The shape of the frame (2) or main frame (1) or an extension thereof at an underlying position of the last section (102) has a recess (316) to accommodate the last section (102) and or a quick-change system (103) or a turning and/or tilting joint (104) or an adapter (105) or a tool (106) or a control member (317) of a tool on the last articulation (102).

The displacement means comprise at least one wheel or more wheels or one or more tracks or a combination, wherein the control can be per wheel or caterpillar, per axle, all wheels, all tracks, or a skid control for wheels or tracks, wherein the displacement means are active during guidance or support of the shaft (205) and/or supports (300, 350) and further optionally limiting the pushing force of the displacement means above a certain height of the upward path (402') of the end (205) of the last section.

At least one control device is mechanical, electrical, hydraulic, pneumatic or a combination thereof.

At least one transmission includes one of the following: planetary system (2003), or a gearbox (2003), or a Strain Wave Gear (Harmonic Drive) type (2004), or a Wittenstein Galaxie type (2004), or of a Cycloid type transmission (2004) or another transmission with a large to very large transmission ratio, or a multi-switched transmission, or a transmission in a transmission (2003).

At least one control or a transmission or a brake is large in diameter and is relatively narrow with at least a ratio of 2 of diameter to 1 of width or depth.

With at least one hydraulic or pneumatic type control device, the energy in a medium, a liquid or a gas is stored under pressure in an accumulator and then releases it again as soon as energy is needed again for this control device, optionally without With the intervention of an accumulator, the energy under pressure is recovered and directly supplied to another controller with one or more valves.

With at least one hydraulic or pneumatic type control device, the energy is converted via a pump into a rotating movement, an electric motor/generator taking the energy and feeding it to an electric energy storage unit, optionally controlled via the control system and with one or more valves and with the option of a pump for multiple control members from multiple sections.

With at least one controller of an electric motor/generator or spindle or electric solenoid, it absorbs the electrical energy itself and feeds it to an electrical energy storage unit.

Each section individually with one or more controllers can recover the energy.

At least one section with control has a controller or ECU, optionally with an inverter or converter or rectifier, or transformer so that energy is supplied to the control or, conversely, recovered, whereby a computer unit or control system controls the energy flow direction to and from the control, optionally based on control instruments.

Is at least one control with a separate hydraulic or pneumatic pump and this pump is driven by a separate electric motor/generator, which is only controlled when energy is needed or energy is recovered, optionally by operating control instruments or a control system or from a computer unit or controller or ECU and optionally with one or more valves.

A first joint pump is for two or more controllers of different sections for the energy supply to these controllers and that there is a second joint pump for energy return of these two or more controllers, which both pumps are controlled by a control system, or a calculation unit or a controller or an ECU, optionally via one or more valves.

The control of one or more valves or braking systems is deployed simultaneously with the control of at least one control member both during an energy supply or energy recovery movement of a section or a tool (106) or a quick-change system (103) or a turning and/or tilting piece (104) or an adapter (105), optionally with the control of an electric motor or a hydraulic motor or a hydraulic or pneumatic pump.

Two or more control members are active per section and two or more sections for the same movement.

The movements of the mobile device and at least one section thereof are programmed The movements of the mobile device and the at least one section thereof are programmed, are optionally continuously changed and/or controlled by a computer unit or control system, optionally by artificial intelligence.

The movements of the mobile device and at least one part thereof are programmed, or are controlled by a driver via control instruments, optionally with haptic feedback.

Operating instruments can be: one or more virtual reality gloves, one or more joysticks, one or more buttons, one or more sliders or rollers, one or more touch-screen displays, virtual-reality glasses, a laser pointer, one or more body movement sensors a voice command or a combination thereof, optionally as input for a computer unit or control system, which can be equipped with artificial intelligence to learn movements of the mobile device and/or sections and then to perform more intelligent, efficient and energy efficient, optionally with a instrument for an ascending or movement or a horizontal or substantially horizontal movement of the end of the last section (102).

A pivot point (204) of the second articulation (102) coincides with a pivot point or engagement point of a control member, optionally the control member for moving the first articulation (101).

Three or more controls have the same locations on the control for pipes or hoses or cables or valves, or controllers, or an ECU or solenoids or a combination, optionally 4 controls.

A pivot point between 2 sections has 2 or more bearing bushes and the pin through the bearing bushes is also the line of the pin or the pin itself is for the pivot point or engagement point of at least one or more control members, optionally the pivot point between the first (101) and the second section (102).

At least 2 pins that are part of different pivot points have exactly the same dimensions and optionally at least 3 pins with exactly the same dimensions for 3 different pivot points.

Two sections lie against each other and support each other in a backward position of the section that is closest to or to the main frame or frame such as, for example, the additional section (100), optionally with support points between the sections of a metal or a pressure-absorbing material such as rubber or plastic.

The main frame (1) or frame (2) has a location or cabin (4, 4') for a driver, this location being oriented next to or behind one or more sections, optionally a seat in the cabin (4, 4') before a driver can be shifted sideways.

The main frame (1) or frame (2) comprises a tunnel towards the sections, through which pipes, hoses and cables run to the sections.

The main frame (1) or frame (2) comprises a floor or floor for a driver, the floor or floor having an inclined surface at the height of the driver's feet, creating space for technical components such as hoses under this inclined surface pipes, cables, valves, an energy storage unit or a motor, optionally a rotary motor for the rotation between the frame and the main frame.

The pressure of a liquid or gas or the amperage and/or voltage is measured in a control device by a sensor and is thereby fed to a control system or control system for measuring the mass of a load, which is lifted by the articulations, optionally maximum height or extent of this load to be indicated by the control system to the driver by the control system or steering system.

On or in the gates and/or the tool (106) and/or a quick-change system (103) and/or a pivot joint (104) and/or an adapter (105) or a combination thereof, a glass fiber, an optical fiber (photonic integrated circuit based fiber sensing) or a combination thereof to follow the movement of the articulation and optionally connected parts.

At least 3 or more controls or 3 or more sections have the same sensor in type and dimensions, optionally the sensors have the same mounting and integration.

At least one control system, computer unit or computer unit or processor or ECU a late movement path from the end of the last section via a control member (102) or the tool (106) or a quick-change system (103) or a swivel and/or tilt joint (104) or an adapter (105) outputting data entered via operating instruments, optionally performing moving end of the first articulation (101) through a controller or moving the end of the additional articulation (100) through a controller.

A calculating unit or control system compares the measured values of at least one sensor with the measured values required from that sensor to realize that movement path and wherein the calculating unit or the control system controls the control device so that the sensor realizes the intended value with a bandwidth of a deviation, optionally via a CAN, CAN-Open, J1939, Byteflight, D2B, VAN, or a Flex Ray bus.

A control system or calculation unit or a data storage unit has coordinates for sections in different dimensions and thereby controls drivers to arrive at these coordinates.

A calculation unit or control system has these coordinates carried out in a two-dimensional plane by the control elements, optionally in a three-dimensional space.

The coordinates are points in a two-dimensional plane or three-dimensional space, along which a path follows for an end of at least one articulation or a tool (106) or a quick-change system (103) or a turning and/or tilting joint (104) or an adapter (105) or a combination thereof and optionally the coordinates are in a matrix.

The coordinates have a mutual distance of less than a millimeter, a millimeter or more, more than 10 mm, more than 100 mm or more than 1000 mm and optionally the calculator itself calculates intermediate coordinate values.

The coordinates are entered via control instruments or a data carrier and the driver is located on or in the mobile device or outside, optionally whereby the coordinates are controlled wirelessly.

During the movement of one or more sections, a tool (106) or a quick-change system (103) or a pivot and/or tilting joint (104) or an adapter (105) or a combination thereof is held parallel to the main frame or the frame or with respect to a signal from a spirit level instrument.

A sensor gives a measurement value and the calculation unit or control system compares this with the intended measurement value of an entered coordinate and then the at least one calculation unit or control system controls a control device to reduce the deviation from the measurement value, optionally until it corresponds to a possible deviation entered by the driver.

The speed of movement, via a control member, of at least one articulation (100, 101, 102) or of a tool (106) or a quick-coupler system (103) or a swivel and/or tilting joint (104) or an adapter (105) is controlled by the computer to limit the energy or flow required by a pump, optionally for two or more sections.

The speed of movement during the course of the path is controlled via coordinates by a computer unit or control system, with optionally the start of an ascending lift path being slow, the middle part faster and the end part the more up again, again slower.

At least the last articulation (102) in a cross-section of a circular or elliptical shape or at least a square or trapezoidal shape or two trapezoidal shapes, optionally with known angles due to two additional settings per corner.

An engagement point of a control member on a main frame (1) or on a frame (2) or on a lateral adjustment (3) for controlling the additional articulation (100) can be moved, optionally via a pivot point which is equal to the pivot (202) of the additional articulation (100) on the main frame (1) or on the frame (2) or on a lateral adjustment (3) and the engagement point being partly within the width of a part of the additional articulation (100) falls.

An engagement point of the control member of the additional articulation (100) consists of a part (500) or two plates (501) which protrude downward through the lateral adjustment (3) during displacement or rotation and thereby this part or these two plates abut in a recess or against at least one wall of the main frame (1) and thereby block a rotation (201) of the lateral adjustment (3) and/or a rotation block (200) between the frame (2) and main frame (1).

A computer unit or control system controls the control members of the articulations, the articulations coming into a position where the point of contact of the control member for the additional articulation (100) on the main frame (1) or on the frame (2) or on the lateral side adjuster (3) can move freely and whereafter the computer unit or control system controls the controls and the sections so that the said point of engagement is positioned in a different position, whereby it can be locked, optionally such that the end of the last section (205) and the support (300/350) is held in a guide (310/310'/311/311'/313/313'/314/314'/315) during the control of the control members and sections.

Hydraulic or pneumatic hoses or pipes or electrical or electronic cables are guided through the sections or run above a part of a structure of the first section (101), which section lies directly above a control member in this section, optionally under another control member between the first section (101) and the last section (102).

Hydraulic or pneumatic hoses or lines or electrical or electronic cables run along the top of the pivot (204) between the first and the second articulation and then through an opening in the second articulation (102) at the rear of this articulation come out for a control member (1040) of a tool (317) on the second section.

A motor for the rotation of the frame (2) is positioned with respect to the main frame (1) between a pivot point of an articulation on the frame and a location of a driver, optional for the location of the feet of the driver.

SHORT FIGURE DESCRIPTION

The above and other advantageous features and objects of the invention will become more apparent and the invention will be better understood with reference to the following detailed description when read in conjunction with the attached drawings, in which FIGS. 1A-1D, 2A-2D, 3A-3P, 4A-4H, 5A-5N, 6A-6X, 7A-7I, 8, 9A-9D, 10A-B illustrate embodiments of the invention.

DETAILED DESCRIPTION OF EMBODIMENTS

Below is an overview of the reference numbers in the figures:

| No. | Description |
|---|---|
| 1 | Main frame with displacement means 20 on which a frame 2 can rotate |
| 1' | Adjustable part of a main frame 1 |
| 2 | Frame with displacement means 20 or a frame without displacement means rotating on a main frame 1 |
| 2' | Adjustable part of a frame 2 |
| 2A | Fender or support block for an additional section |
| 3 | Lateral adjustment between a frame 2 and a section |
| 4 | Location for a driver or a cabin |
| 5 | Mudguard for means of transport, part of 1, 1" or 2, 2" |
| 4' | Location for a driver or a cabin |
| 20 | Displacement means such as a wheel or a caterpillar or a plurality of wheels or a plurality of tracks |
| 100 | Additional section |
| 100A | Part of a structure or a plate in or on an additional section 100 |
| 100-100 | Cross section of an additional section 100 |
| 101 | First section |
| 101A | Part of a structure or a plate in or on a first section 101 |
| 101B | Part of a structure or a fixed plate in or on a first section 101 |
| 101-101 | Cross section of a first section 101 |
| 102 | Second section, also a possible last section |
| 102A | Part of a structure or top plate in or on a second section 102 |
| 102B | Conduit made of wear-resistant or stainless material for hoses, pipes or cables in or on a second section 102 |
| 102-102 | Cross section of a second section 102 |
| 103 | Quick-coupler system for connecting a tool or pivot and/or tilt joint, or adapter |
| 104 | Swivel and/or tilt joint |
| 105 | Adapter or a second quick-change system |
| 106 | Tools in various shapes and versions |
| 107 | Platform or safety cage for people/people for working at heights |
| 200 | Hinge point, vertical or nearly vertical between a main frame 1 and a frame 2 which allows more than 360° rotation between a main frame 1 and frame 2 |

-continued

| No. | Description |
|---|---|
| 201 | Hinge point, vertical or nearly vertical between a frame 2 and a side adjustment 3 |
| 202 | Hinge point, horizontal or almost horizontal between a frame 2 and an additional articulation 100 or between a lateral adjustment 3 and an additional articulation 100 |
| 203 | Hinge point, horizontal or nearly horizontal between an additional articulation 100 and a first articulation 101 |
| 203' | Hinge point, horizontal or almost horizontal between a frame (2) on displacement means 20 or between a frame 2 which can rotate on a main frame 1 |
| 204 | Hinge point, horizontal or almost horizontal between a first section 101 and a second section 102 |
| 205 | Hinge point, horizontal or nearly horizontal between a second articulation 102 and a quick-change system 103 or a pivot and/or tilting joint 104 or an adapter 105 or a tool 106 or a combination thereof. The pivot point is at the free end of the second articulation 102. This can also depict or be an axis or a pin. |
| 205' | Hinge point, horizontal or almost horizontal in line with hinge point 205 in or on a quick-change system 103 or a swivel and/or tilting joint 104 or an adapter 105 or a tool 106 or part thereof. This can also depict or be an axis or a pin. |
| 206 | Hinge point, horizontal or substantially horizontal between a second articulation 102 and a control member 1040 for a tool 317 |
| 300 | Support for a quick-change system 103 or a turning and/or tilting joint 104 or an adapter 105 or a tool 106 or a combination thereof. The support is in line with or hinges around the line of pivot point 205. |
| 310 | Straight guide for a pin or axle of pivot point 205 or for a support 300, 350 in or on 1, 1", 2, 2" or a part thereof |
| 310' | Straight-line guide for a pin or axle of pivot point 205 or for a support (300, 350) opposite 310 in to 1, 1", 2, 2" or a part thereof |
| 311 | Curved guide for a pin or axle of pivot point 205, 205" or for a support 300, 350 in or on 1, 1", 2, 2" or a part thereof |
| 311' | Curved guide for a pin or shaft of pivot point 205, 205" or for a support 300, 350 opposite 311 in or on 1, 1", 2, 2" or a part thereof |
| 312 | Flat, chamfered or rounded part of support 300 or shaft or pin 205 for lateral guidance |
| 313 | Flat, chamfered or rounded part of guide 310 or 311 for lateral guidance |
| 313' | Flat Curved guidance in or on 1, 1", 2, 2" opposite 313 |
| 315 | Lower guide or lower vertical limit of a guide for an axle 205, 205" or support 300, 350 |
| 316 | Space for movement in or border of a frame 2, 2" or a main frame 1, 1" for a section 102, 101, 100 |
| 317 | Tools in various forms and designs |
| 318 | Guidance as part of 310 or 311 with a protrusion directed away from the main frame 1 or frame 2 |
| 319 | Section as part of 310 or 311 with a chamfer or rounding in the direction of a main frame 1 or a frame 2 |
| 320 | Height block for an axle 205 or support 300, 350 |
| 350 | Support for a quick-change system 103 or a swivel and/or tilting joint 104 or an adapter 105 or a tool 106 or a combination thereof. The support is in line with or hinges around the line of pivot point 205 and 205". |
| 351 | Flat, chamfered or rounded part of support 350 or shaft or pin 205' for lateral guidance |
| 352 | Flat, chamfered or rounded part of guide 310 or 311 for lateral guidance |
| 400 | Straight vertical or nearly vertical up or down movement of pivot point 205 |
| 401 | Oblique upward or downward movement of pivot point 205 with an upper part farther away from a frame |
| 402 | Upward or downward movement of pivot point 205 with one or more buckling points and with an upper part further away from a frame than a lower part |
| 402' | Buckling point in a lower part of an upward or downward movement of pivot point 205, wherein the buckling point is a transition between a vertical lower part and a slanted middle part |
| 402' | Buckling point in an upper part of an upward or downward movement of pivot point 205, wherein the buckling point is a transition between an inclined middle part and a vertical upper part and where the buckling point is further away from a frame than a lower angled part |
| 403 | Curved upward or downward movement of pivot point 205, with an upper part further away from a frame than a lower part |
| 404 | Curved upward or downward movement of pivot point 205, with a middle part farther away from a frame than a lower and an upper part |
| 405 | Multiple curved up or down movement of pivot point 205 |
| 406 | Upward movement of pivot point 205, which via at least one pivot point passes to a horizontal movement of pivot point 205 or vice versa |
| 407 | Upward movement of pivot point 205, which flows smoothly to a horizontal movement of pivot point 205 or vice versa |
| 408 | Upward movement of pivot point 205, which via at least one pivot point passes to a horizontal movement of pivot point 205 or vice versa, wherein a frame 2 is rotated relative to a main frame 1 |
| 409 | Upward movement of pivot point 205, which flows smoothly to a horizontal movement of pivot point 205 or vice versa, wherein a frame 2 is rotated relative to a main frame 1 |
| 500 | Part of an additional articulation 100 or part of an engagement point of a control member 1000, which blocks a rotation of a frame 2 relative to a main frame 1 and/or ensures that a rotation of a lateral adjustment is blocked. 3 |
| 501 | Plates of an additional articulation 100 or plates of an engagement point of a control member 1000, which blocks a rotation of a frame 2 relative to a main frame 1 and/or ensures that a rotation of a lateral adjustment 3 is blocked. |

-continued

| No. | Description |
|---|---|
| 1000 | Control device for the movement of an additional articulation 100, for example a cylinder or spindle or motor |
| 1001 | Point of engagement or pivot point of a control member 1000 |
| 1001' | Point of engagement or pivot point of a control member 1000 for a more reclined position of an additional articulation 100 |
| 1002 | Point of engagement or pivot point of a control member 1000 |
| 1003 | Spacer between pivot point 202 and engagement point or pivot point 1001 or 1001' |
| 1004 | Blocking point of engagement of control element for an additional articulation 100 |
| 1005 | Hoses, lines or cables for control unit 1000 |
| 1010 | Control device for the movement of a first articulation 101, for example a cylinder or spindle or motor |
| 1011 | Point of engagement or pivot point of a control member 1010 |
| 1012 | Point of engagement or pivot point of a control member 1010 |
| 1015 | Hoses, lines or cables for control unit 1010 |
| 1020 | Control device for the movement of a second articulation 102, for example a cylinder or spindle or motor |
| 1021 | Point of engagement or pivot point of a control member 1020 |
| 1025 | Hoses, lines or cables for control element 1020 |
| 1030 | Control device for the movement of a quick-change system 103 or a turning and/or tilting joint 104 or an adapter 105 or a tool 106 or a combination thereof, for example a cylinder or spindle or motor |
| 1035 | Hoses, lines or cables for control unit 1030 |
| 1040 | Control device for the movement of a tool 317, for example a cylinder or a spindle or a motor |
| 1045 | Hoses, lines or cables for a quick-change system 103 or a turning and/or tilting joint 104 or an adapter 105 or a tool 106 or a combination thereof |
| 1055 | Hoses, lines or cables for control unit 1040 |
| 2000 | Electric motor or hydraulic motor or pneumatic motor for moving a frame 2 or a lateral adjustment 3 or an articulation 100, 101, 102 or a quick-change system 103 or a turning and/or tilting joint 104 or an adapter 105 or a tool 106 or a combination thereof |
| 2001 | Axle of electric motor or hydraulic motor or pneumatic motor |
| 2002 | Brake or braking device |
| 2003 | Transmission or gearbox or planetary system or a multiple or multi-stage transmission or gearbox or planetary system |
| 2004 | Transmission or gearbox or deceleration mechanism of a Strain Wave Gear (Harmonic Drive) type, or a Wittenstein Galaxie type or a cycloid type transmission |
| 3000 | Encoder, or a rotation angle sensor, or a rotation vector sensor, or a linear sensor, or an accelerator sensor, or a gyroscope sensor, or a gravity sensor, or a camera, or an optical fiber (photonic integrated circuit based sensing) |
| 4000 | View line for driver up to 205, 103, 104, 105, 106 |
| 5000 | Hydraulic or pneumatic valve |
| M | Electric engine or combustion engine |
| P | Hydraulic or pneumatic pump |
| G | Electric generator |

Figure 1A:
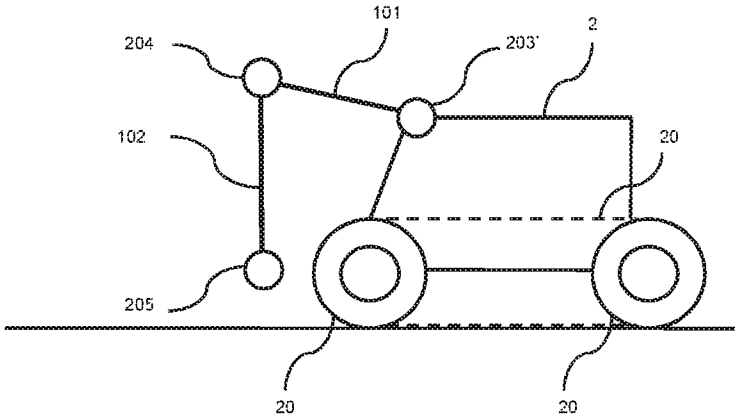
Figure 1B:
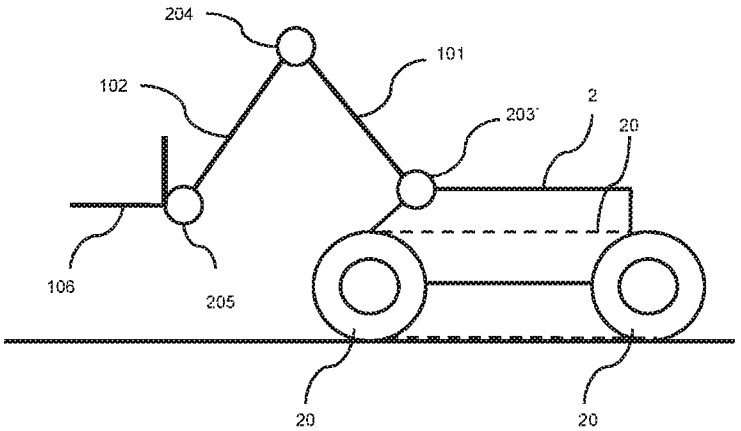

FIGS. 1A and 1B

Side view of a mobile device with displacement means and a first and a second articulation.

Figure 1C:
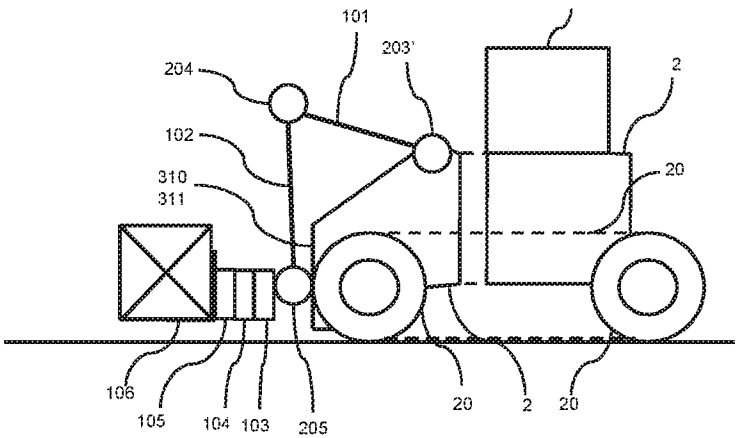
Figure 1D:
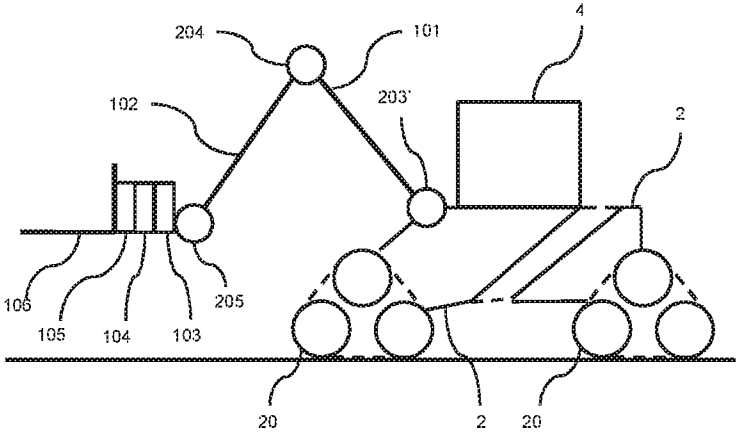
Figure 2A:
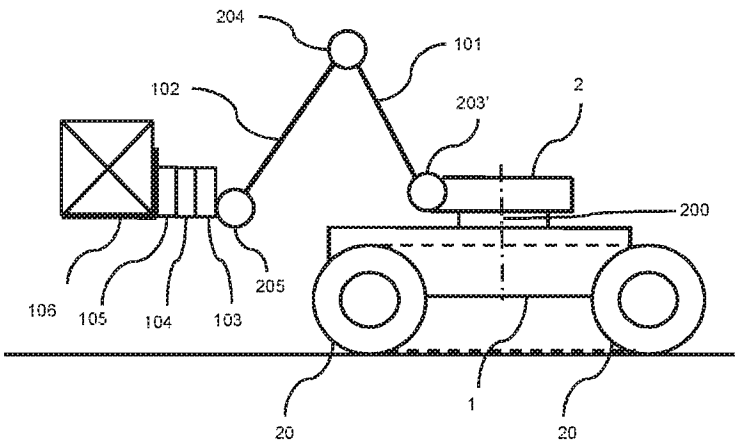
Figure 2B:
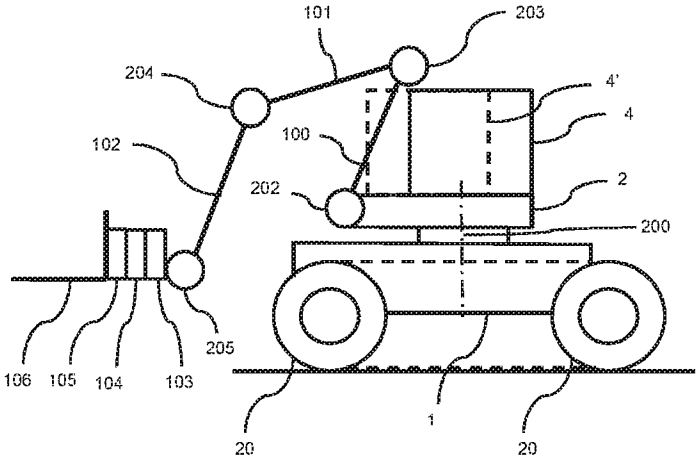
Figure 2C:
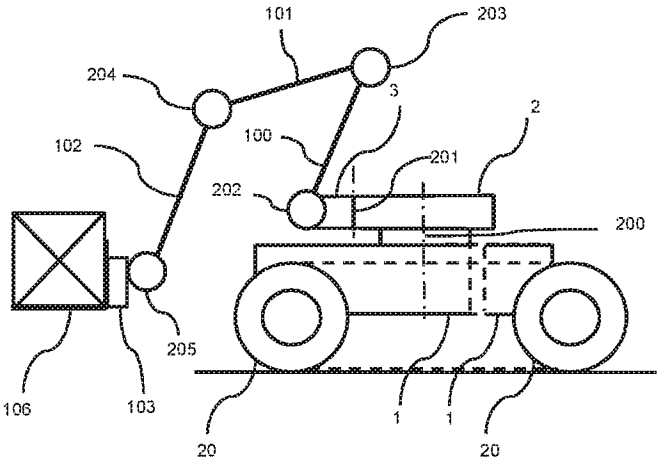
Figure 2D:
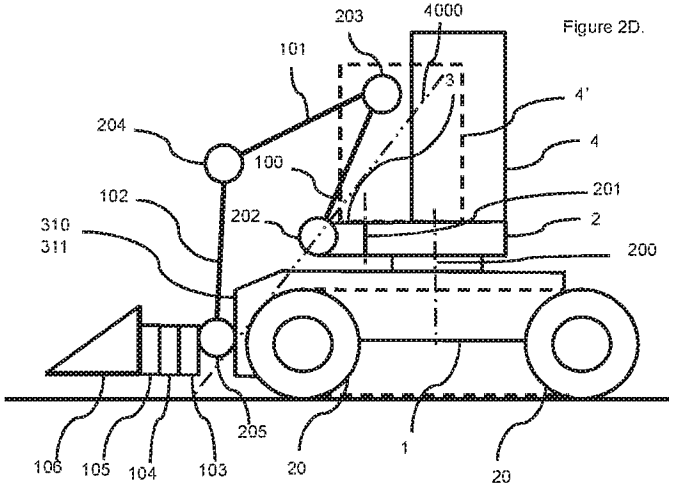

FIGS. 1C and 1D

Side view of a mobile device with displacement means and a first and a second articulation with a bend control.

FIG. 2A

Side view of a mobile device with displacement means, a frame rotating on a main frame with a first and a second articulation.

FIG. 2B

Side view of a mobile device with displacement means, a frame rotating on a main frame with a first, second and additional articulation.

FIG. 2C

Side view of a mobile device with displacement means, a frame rotating on a main frame with a first, second and additional articulation and a lateral adjustment and an embodiment of an articulated steering.

FIG. 2D

Side view of a mobile device with displacement means, a frame rotating on a main frame with a first, second and additional articulation, a lateral adjustment and a location for a driver or cabin.

FIGS. 3A-3F

Side view of a first, second and additional articulation, with the additional articulation in a backward position, with the end of the second articulation 205 making an upward movement per successive figure, with the pivot point, pin or shaft 205 and the support 300 or support 350 are guided in the lower positions by guides 300 or 310, wherein the orientation of the different hinge points of the articulations with respect to each other is visible and wherein the tool retains a horizontal position in each position.

FIG. 3B

Side view of a first, second and additional section, with a position of a driver positioned next to or behind the sections.

FIG. 3G

Side view of a first, second and additional articulation, the additional articulation being in a more vertical position allowing the end of the second articulation 205 to move into a higher position.

FIG. 3H

Side view of a first, second and additional articulation, the additional articulation being in a backward position and end of the second articulation 205 making a stretching movement.

FIG. 3I

Side view of a first, second and additional articulation, with the additional articulation being more vertical allowing the end of the second articulation 205 to make a further stretching movement.

FIG. 3J

Side view of a first, second and additional articulation, the end of the second articulation making a digging movement.

FIGS. 3K-3M

Graphs of an upward movement, wherein the vertical axis of the graph represents the required energy level with a rotation of the indicated hinge points 202, 203, 203', 204 and 205 of sections or quick-change system, swivel and/or tilting joint, adapter or tool in ratio to the height of the upward movement on the horizontal axis.

FIG. 3K

It can be seen here that only the first and second articulation and the pivot point 205 pivot and at what point in the height of the upward movement whether energy is required or energy can be generated.

FIG. 3L

It can be seen here that the first and second articulation and pivot point 205 pivots and at the end of an upward movement also the additional articulation hinges and at which moment in the height of the upward motion whether energy is required or energy can be generated.

FIG. 3L

It can be seen that all pivot points pivot simultaneously. It is then dependent on the mass of the load at the end of the second articulation and the mass of the articulations and controls whether energy is needed for the additional articulation or whether energy can be generated. Various scenarios have been depicted.

FIGS. 3N-3P

Graphs of a downward movement, the vertical axis of the graph representing the required energy level with rotation of the indicated pivot points 202, 203, 203', 204 and 205 of sections or quick-change system, swivel and/or tilting joint, adapter or tool in ratio to the height of the downward movement on the horizontal axis.

FIG. 3N

It can be seen here that only the first and second articulation and the pivot point 205 pivot and at which moment in the height of the downward movement energy is required or energy can be generated.

FIG. 3O

It can be seen here that the first and second articulation and pivot point 205 pivots and at the start of a downward movement also the additional articulation hinges and at which moment in the height of the downward motion whether energy is required or energy can be generated.

FIG. 3P

It can be seen here that all pivot points pivot simultaneously. It depends on the mass of the load at the end of the second articulation and the mass of the articulations and control members whether energy is needed for the additional articulation or whether energy can be generated. Various scenarios have been depicted.

FIGS. 4A-4J

Figure 4I:
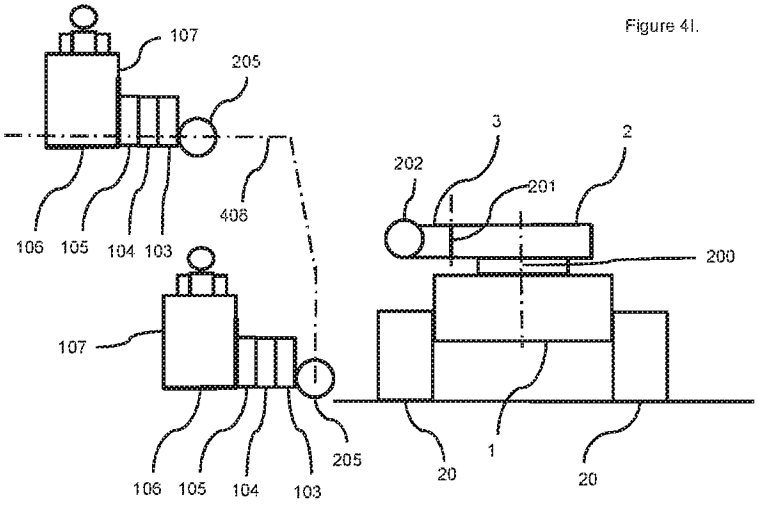
Figure 4J:
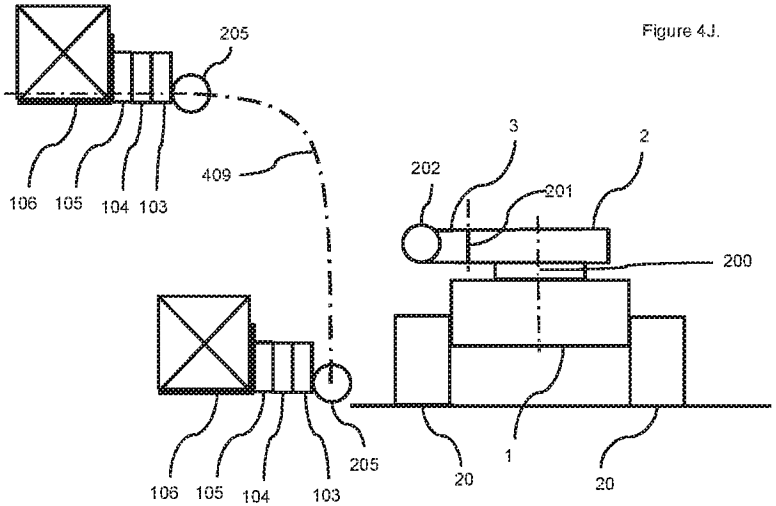

Different forms of upward and downward movements, already described with the indicated figure numbers and wherein FIGS. 4A to 4H are side views of a mobile device and wherein FIGS. 4I and 4J are front or rear views.

FIG. 4I

Front or rear view of a mobile device with a tool as a platform or safety cage for people/people for working at heights.

FIGS. 5A-5B

Figure 5A:
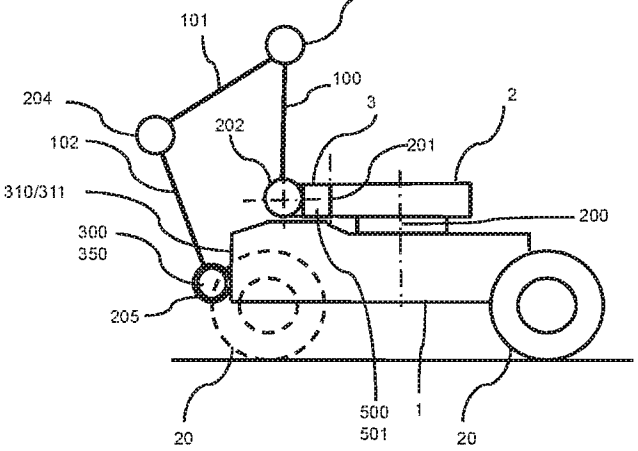
Figure 5B:
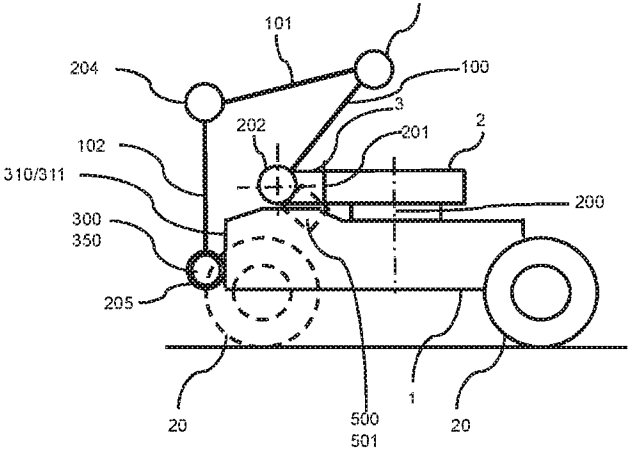

Side view of a mobile device where FIG. 5A indicates that the additional articulation is in a more vertical position and is thereby no blocking between the frame and main frame and is not blocking the lateral adjustment, with FIG. 5B showing the additional articulation in a backward position and there is a blockage of the frame and the lateral adjustment.

FIGS. 5C-5D

Figure 5E:
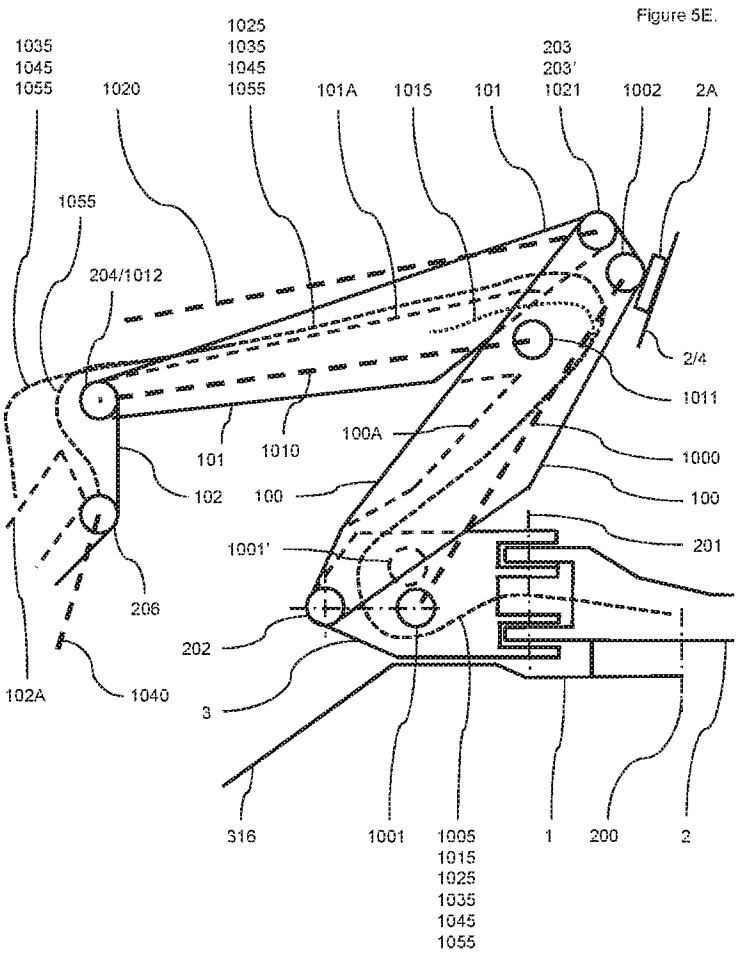
Figure 5C:
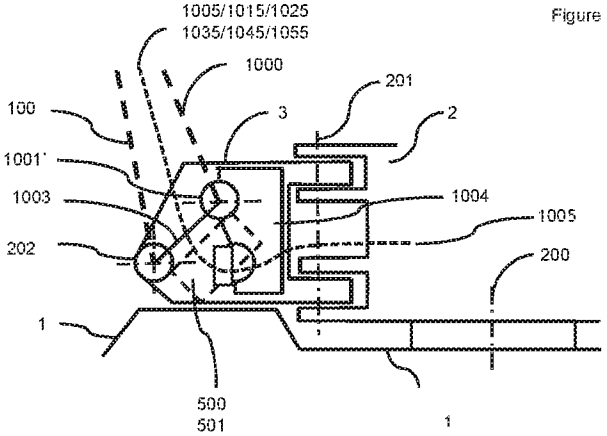
Figure 5D:
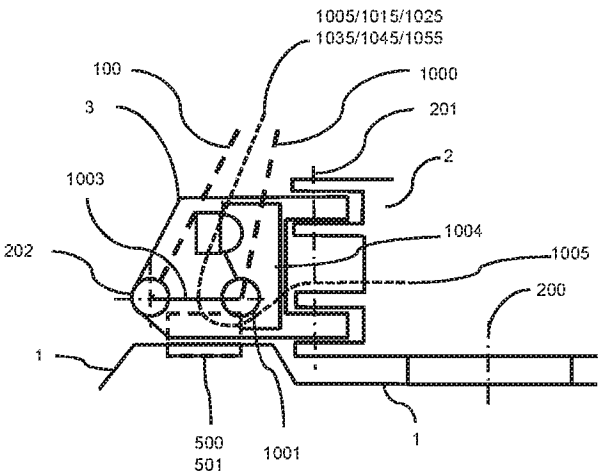
Figure 5G:
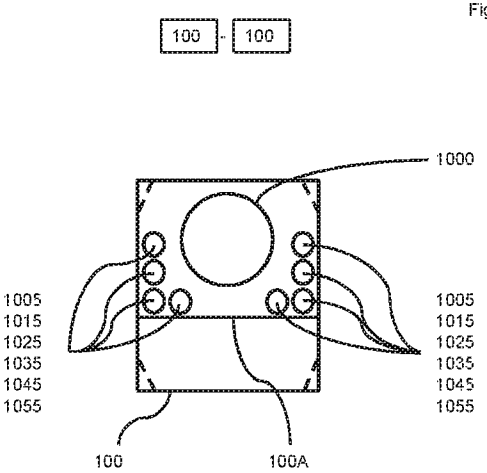
Figure 5H:
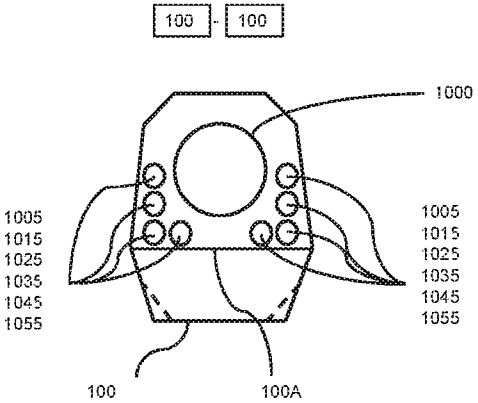
Figure 5F:
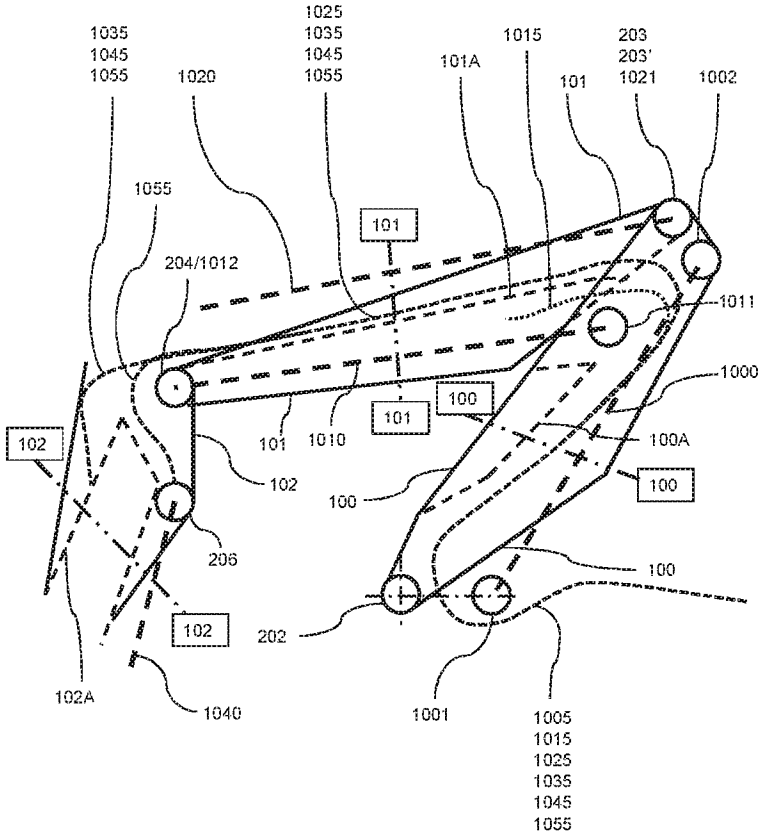
Figure 5K:
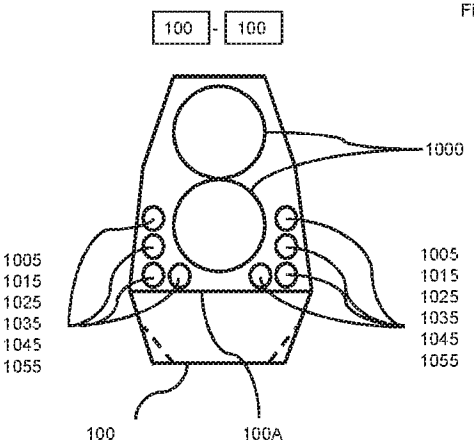
Figure 5L:
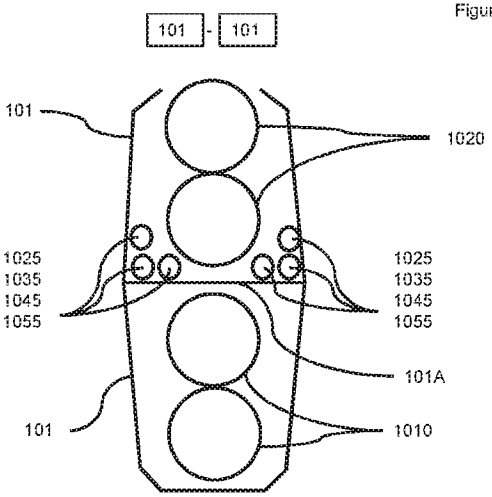
Figure 5I:
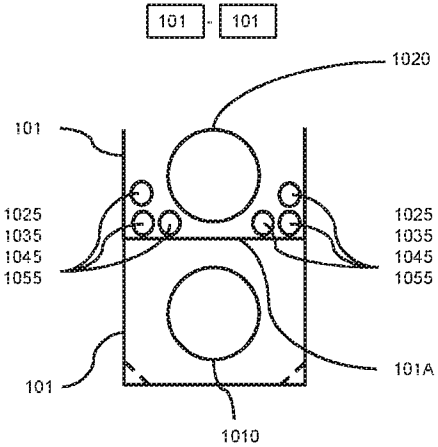
Figure 5J:
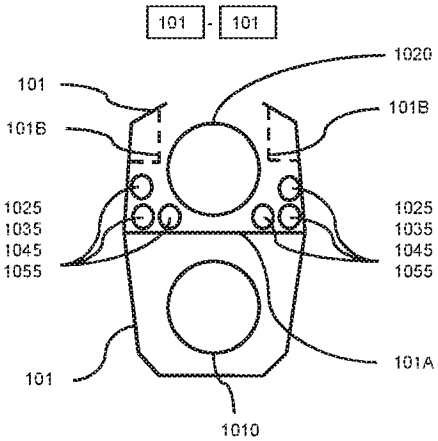
Figure 6A:
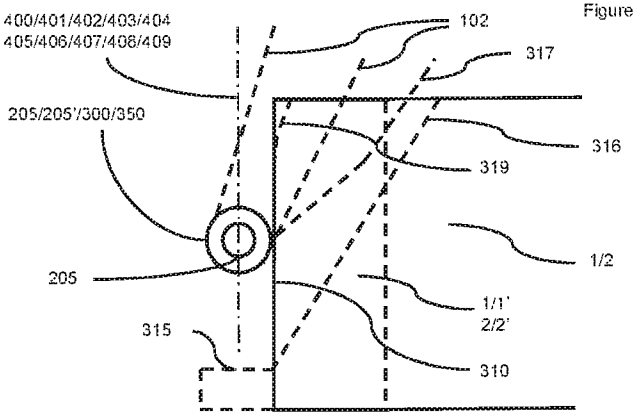
Figure 6B:
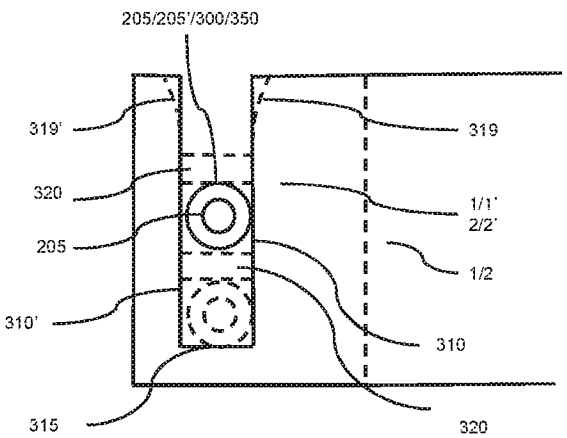
Figure 5M:
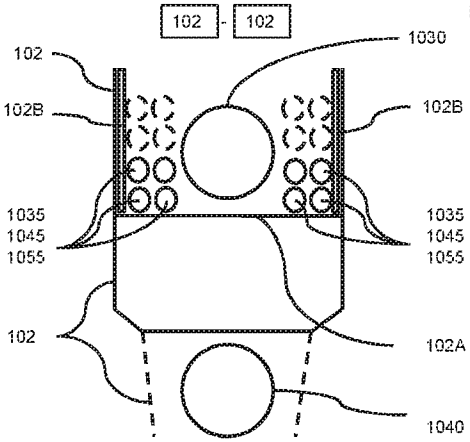
Figure 5N:
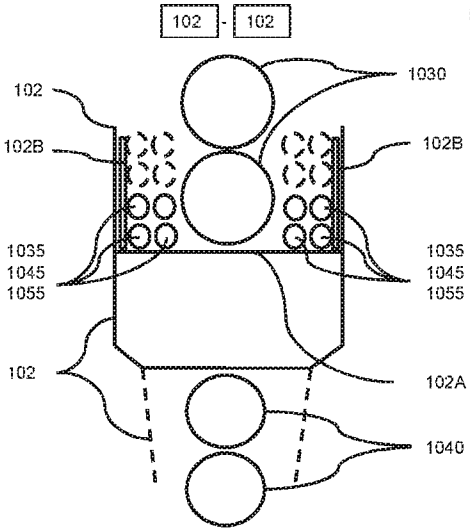
Figure 6E:
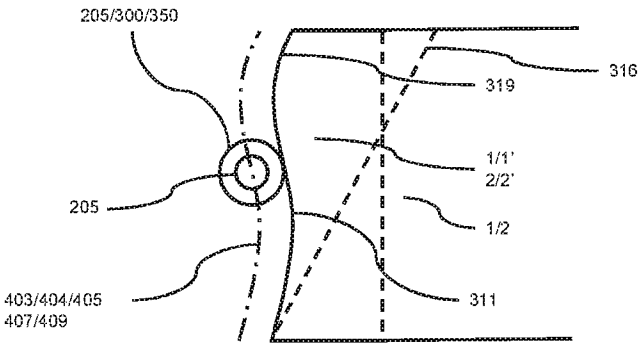
Figure 6F:
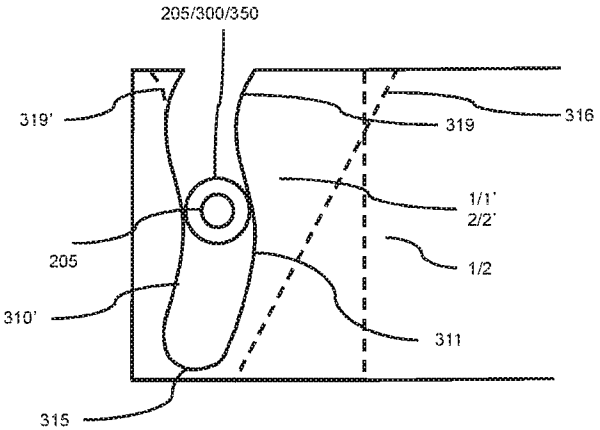
Figure 6C:
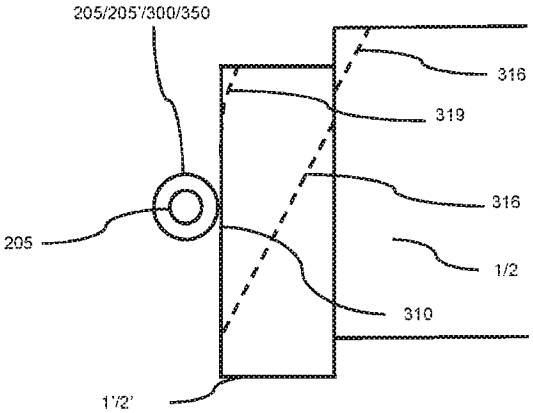
Figure 6D:
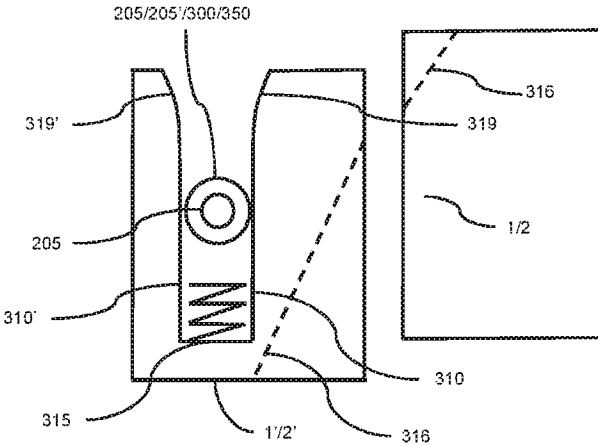
Figure 6I:
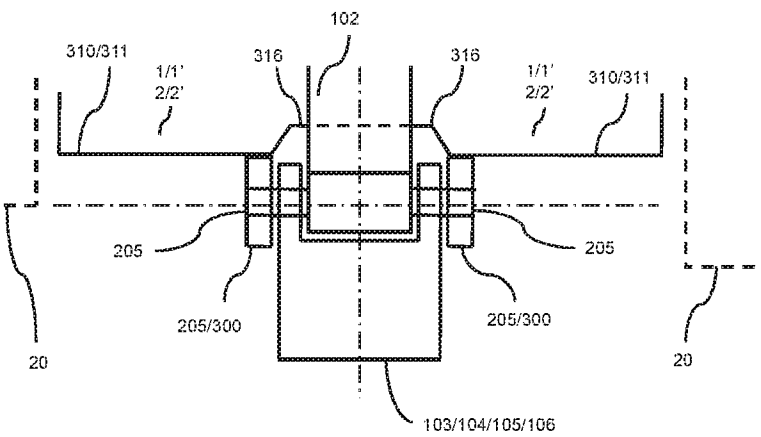
Figure 6J:
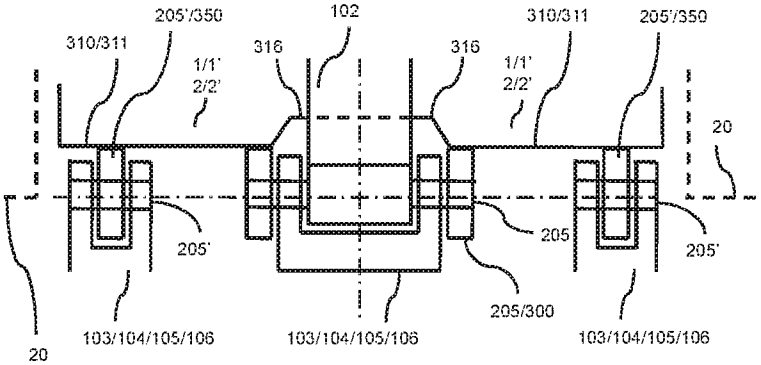
Figure 6G:
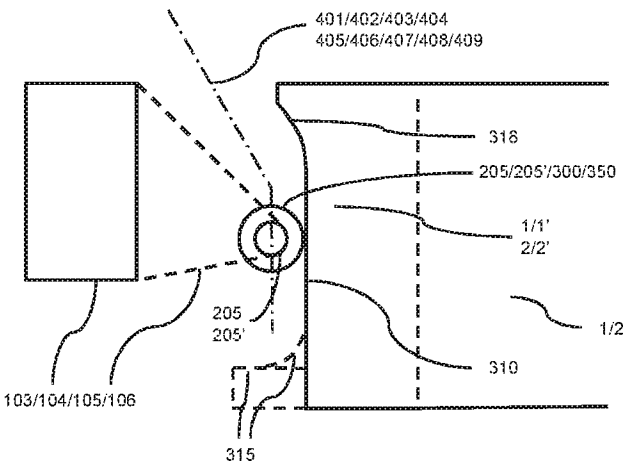
Figure 6H:
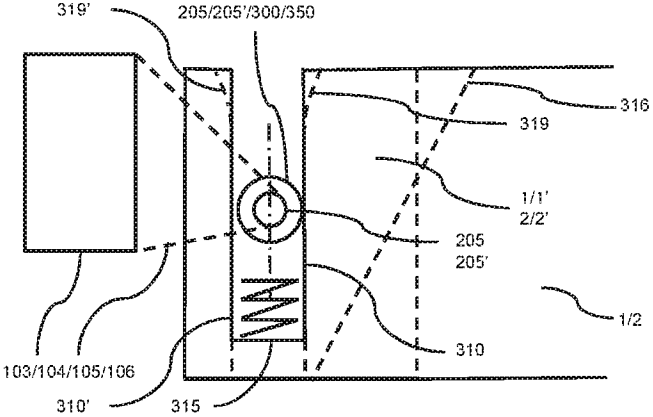
Figure 6M:
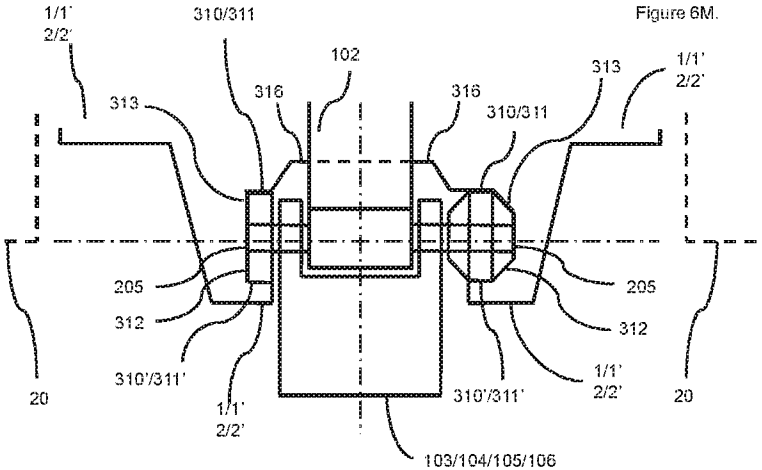
Figure 6K:
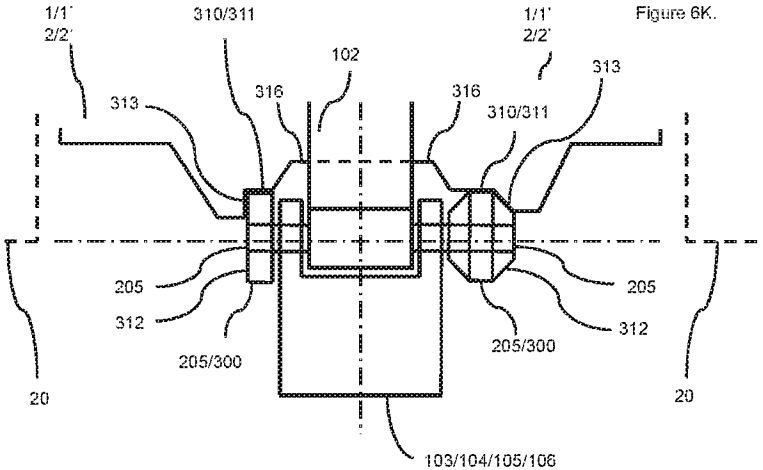
Figure 6N:
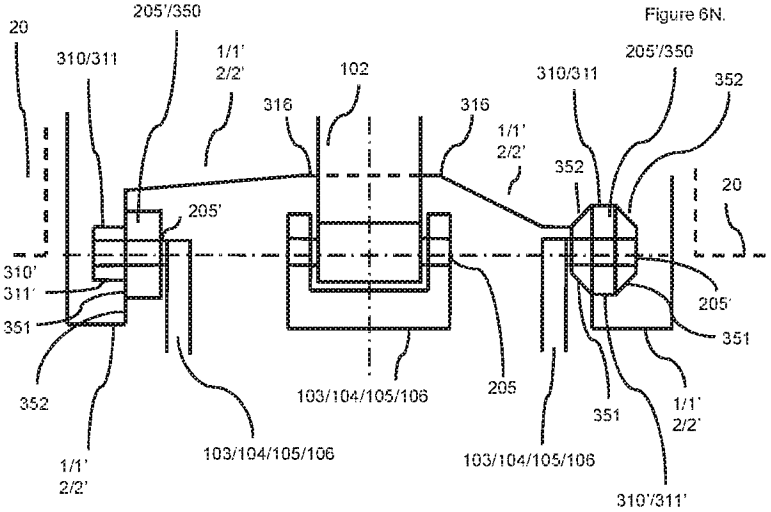
Figure 6L:
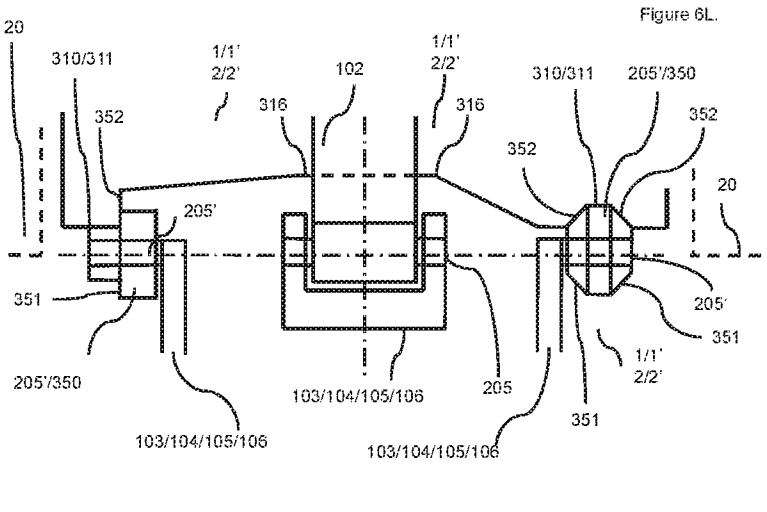
Figure 6Q:
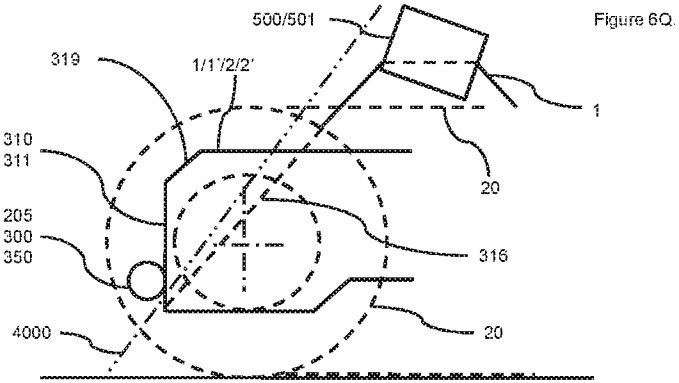
Figure 6R:
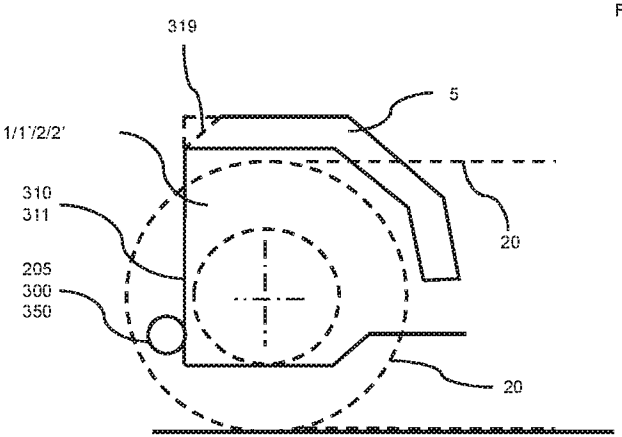
Figure 6O:
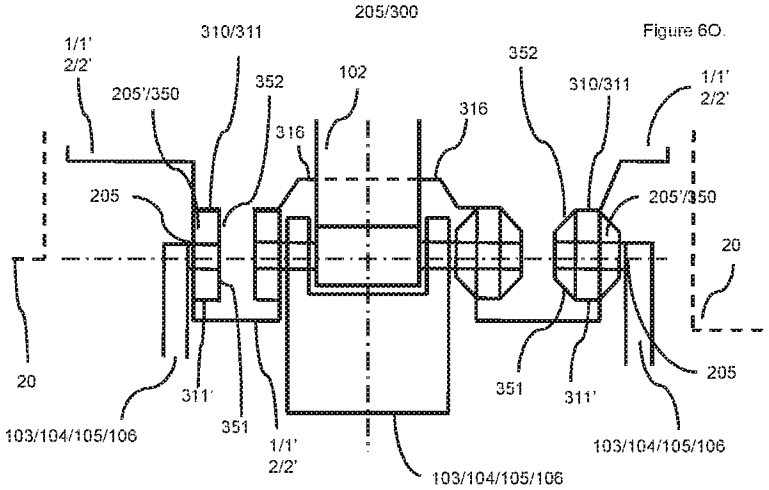
Figure 6P:
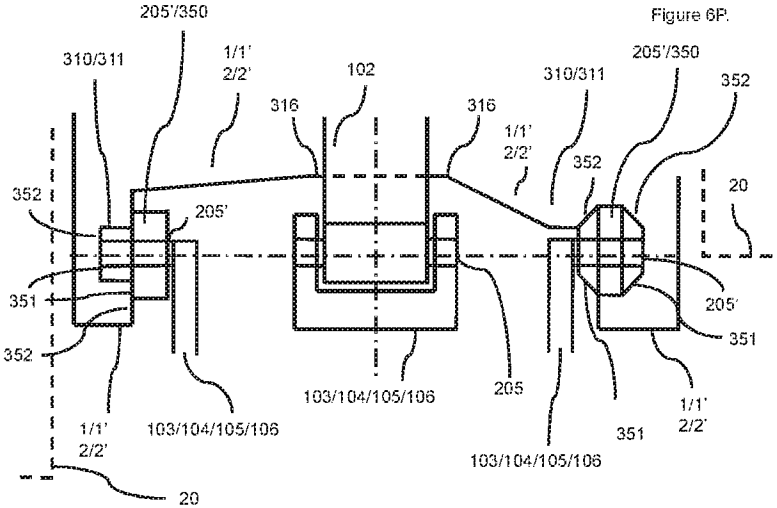
Figure 6U:
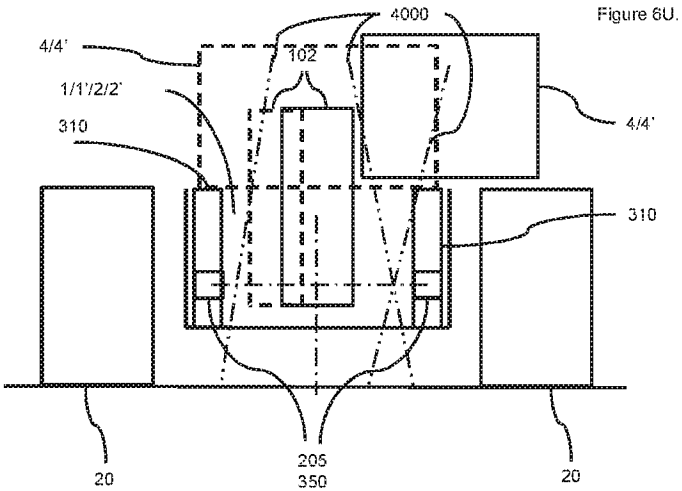
Figure 6V:
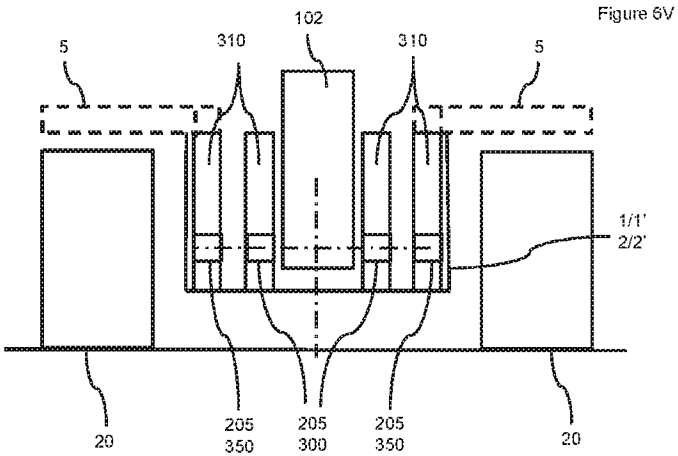
Figure 6S:
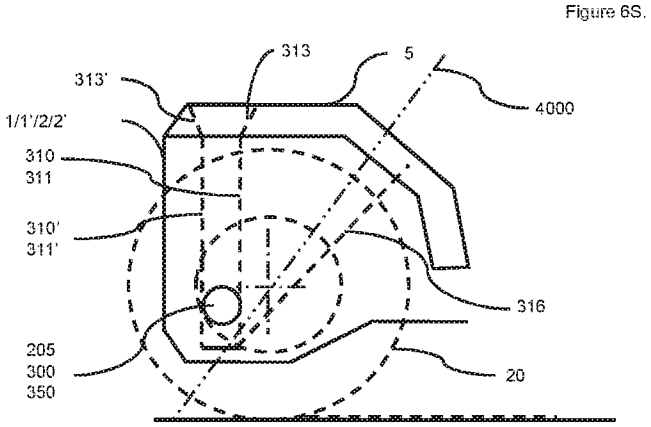
Figure 6T:
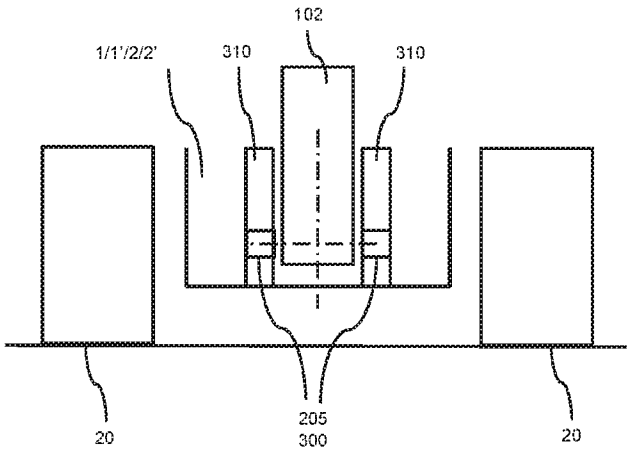

Side views of a blocking of a point of engagement of a control member for an additional articulation, in which FIG. 5D shows a blocking of the frame on the main frame and of a lateral adjustment.

FIGS. 5E-5F

Side views of articulated embodiments, with the orientation of articulated in relation to the pivot points thereof, to control members to engagement points or pivot points of control members, to structural parts and to pipes, hoses and cables.

FIG. 5F

Side view of embodiments of sections, with sections of these sections indicated.

FIGS. 5G-5N

Cross sections of embodiments of sections, indicating the orientation and proportions of structures of sections, of forms of structures and forms of parts thereof, of control members, of pipes, hoses and cables. In these figures, embodiments of controls are shown as cylinders or spindles.

FIG. 5M

Cross sections of embodiments of a second articulation wherein it is indicated that the pipes, hoses or cables can shift in height (dotted lines) during the movement of this second articulation relative to the first articulation.

FIGS. 5J, 5L, 5N

Cross sections of embodiments of sections, wherein the control members are shown as spindles with associated motors.

FIGS. 6A-6X

Various views of embodiments of guides for the end of the second articulation 205 or pin or shaft 205 or support 300 or 350 for a quick-change system, a pivot and/or tilt joint, an adapter or a tool during an upward or downward movement thereof, flowing shapes of the guides rounded off in a number of views are indicated.

FIG. 6A

Side view of an embodiment of a linear guide.

FIG. 6B

Side view of an embodiment of a linear guide on two sides and the underside, wherein also a blocking in the height (320) is indicated.

FIG. 6C

Side view of an embodiment of a guide, wherein the height of the guide is adjustable relative to the frame or main frame.

FIG. 6D

Side view of an embodiment of an articulation on two sides and the underside, wherein a guide can be adjusted in height and in a horizontal direction relative to a frame or main frame and where a damping construction of a guide is visible on the underside.

FIG. 6E

Side view of an embodiment of a guide with a curved shape.

FIG. 6F

Side view of an embodiment of a guide with a curved shape on two sides and on a bottom side.

FIGS. 6G-6H

Side views of embodiments of a guide, where it is visible that an upward or downward movement of the end of the second articulation has no influence on the freedom of rotation of a tool, or quick-change system or swivel and/or tilting joint or adapter.

FIGS. 6I-6P

Top views of embodiments of guides, wherein a tool, or quick change system, or pivot and/or tilting joint or adapter is guided in one or more directions on one or more sides of one or more guides. Relations with relocation means are also given. Moreover, it is shown in which way implementations of a tool, quick-change system, pivot and/or tilting joint can be coupled and oriented to an axis or pin through a pivot point 205 and various supports 300, 350.

FIGS. 6Q-6S

Side views of embodiments of guides, wherein the orientation and ratios of guides are indicated to displacement means, to sight lines, to a frame and a main frame, to movement space of sections (316) and to possible mudguards.

FIGS. 6T-6W

Front or rear views of guide embodiments, wherein the orientation and ratios of guides are indicated to displacement means, to sight lines, to a frame and a main frame, to a second articulation, to a location for a driver or cabin and to possible mudguards. It can also be seen that guides can be funnel-shaped at the top

FIG. 6U

Front or rear view of an embodiment of a guide in which a last articulation can be placed centrally, but also from the center of the mobile device and in which a location for a driver or cabin can be placed centrally, but also from the center.

FIG. 6X

Top view of an embodiment of a guide, wherein the orientation and proportions are indicated to a lateral adjustment of a second articulation.

FIGS. 7A-7I

Various views of embodiments of controls in the form of electric, hydraulic, or pneumatic motors, indicating the orientation and ratios of articulations, a frame, a main frame, a lateral adjustment, sensors, transmissions, and a brake.

FIG. 7A

Figure 7A:
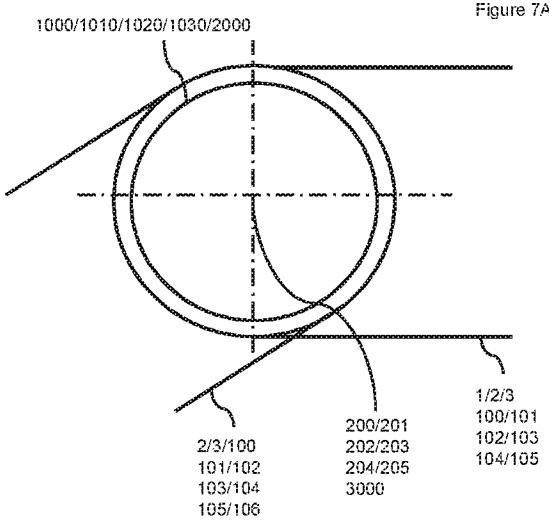
Figure 7B:
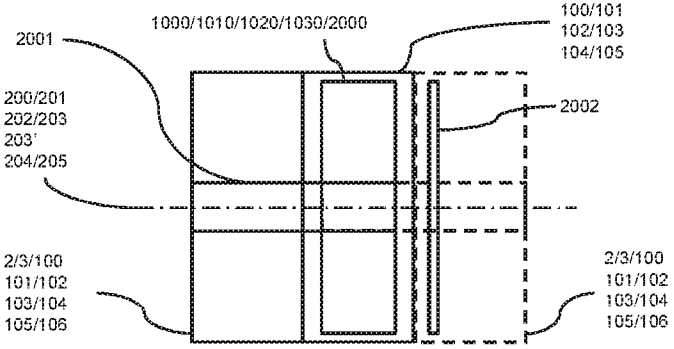
Figure 6W:
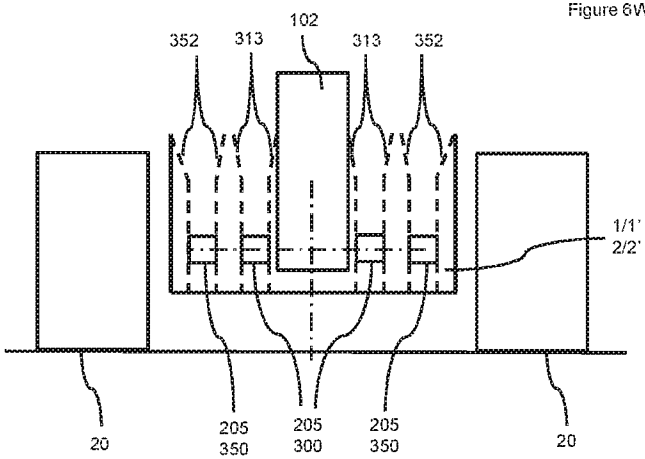
Figure 6X:
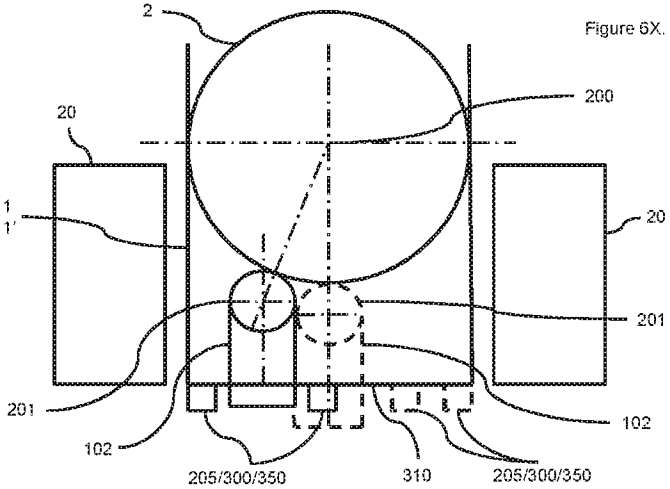
Figure 7E:
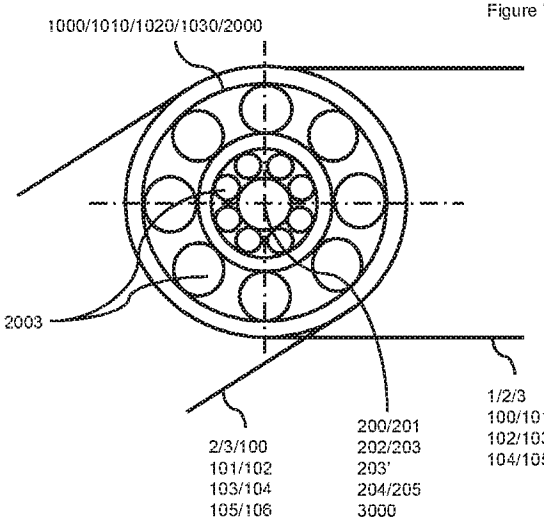

Side view or top view of an embodiment of an electric, hydraulic or pneumatic motor with a direct drive of a section or a lateral adjustment or a frame. A cross-section thereof is shown in FIG. 7B.

FIG. 7C

Side view or top view of an embodiment of an electric, hydraulic or pneumatic motor with a planetary system transmission of a joint or a lateral adjustment or a frame, the motor being positioned next to the transmission. A cross-section thereof is shown in FIG. 7D.

FIG. 7E

Figure 7F:
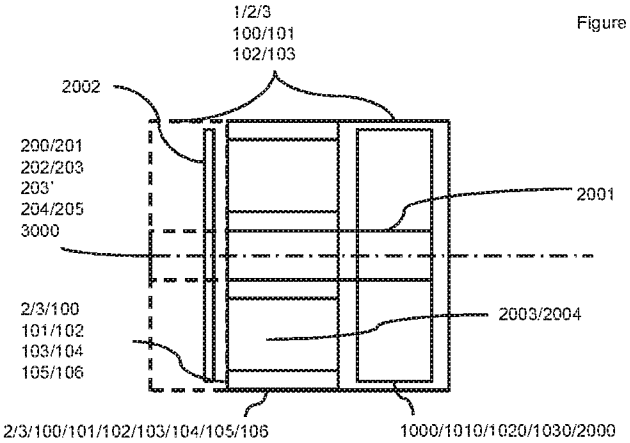
Figure 7C:
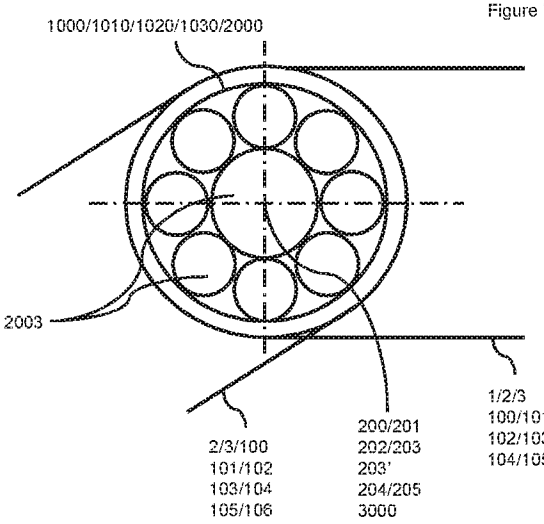
Figure 7D:
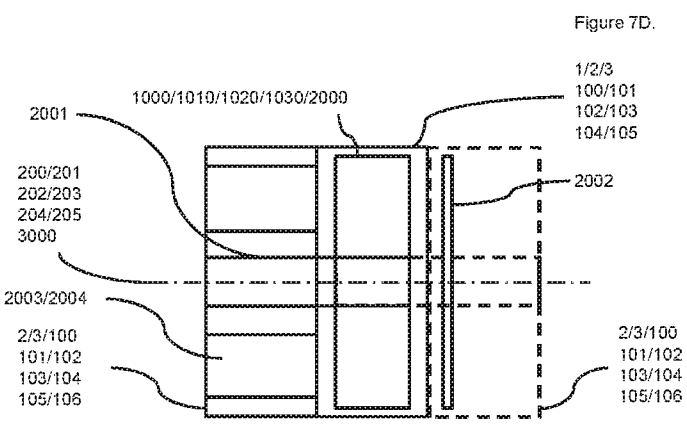
Figure 7I:
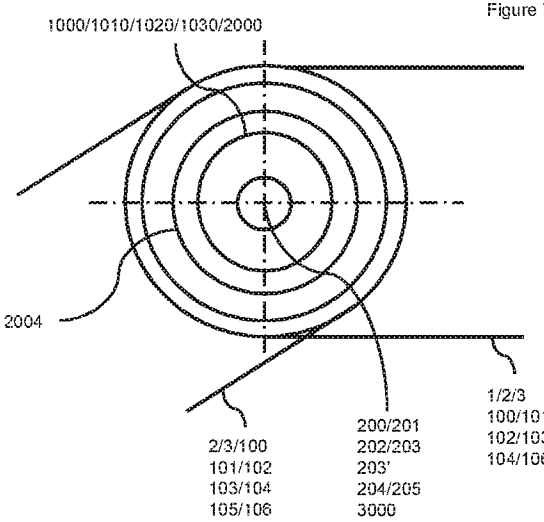
Figure 7G:
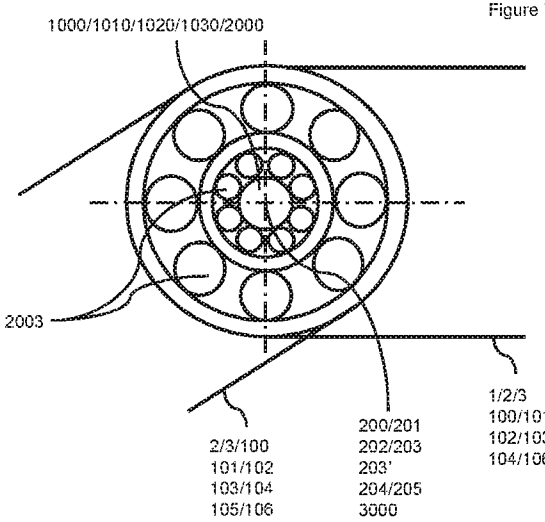

Side view or top view of an embodiment of an electric, hydraulic or pneumatic motor with a planetary system transmission in a second planetary system transmission of an articulation or a lateral adjustment or a frame, the motor being positioned next to the transmissions, is a cross section thereof in FIG. 7F.

FIG. 7G

Figure 7H:
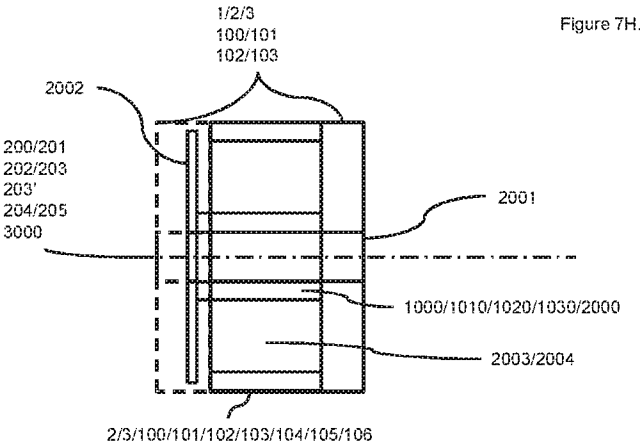
Figure 9B:
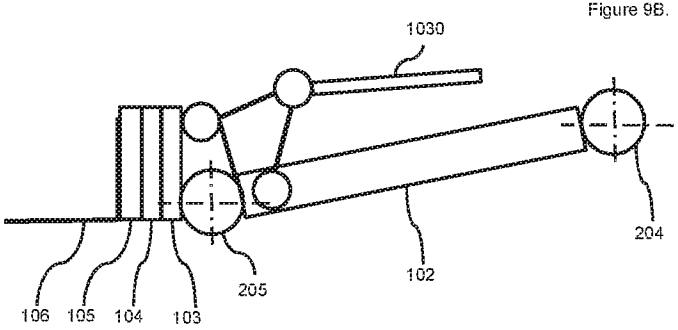
Figure 9C:
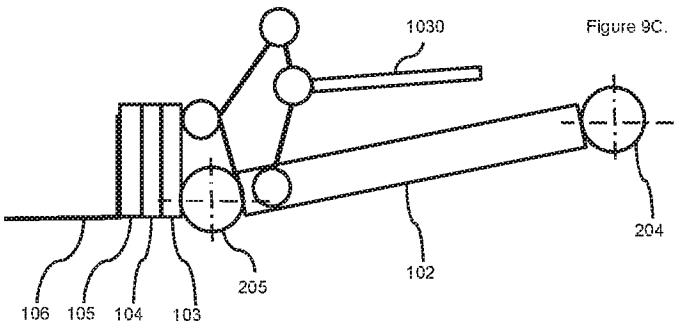
Figure 9D:
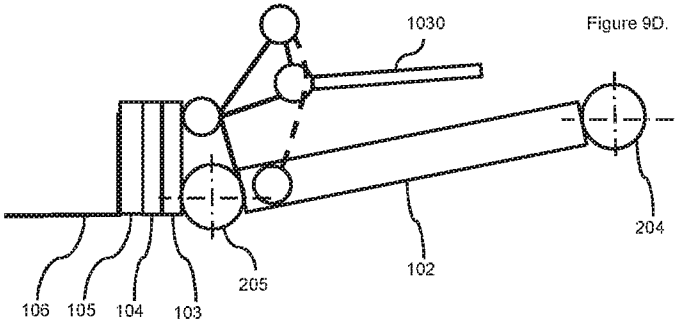
Figure 8:
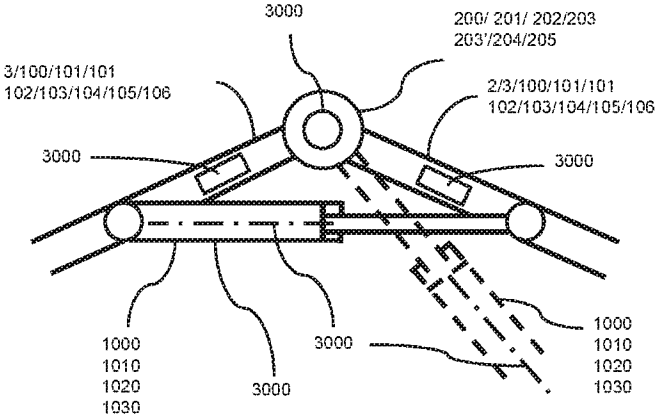
Figure 9A:
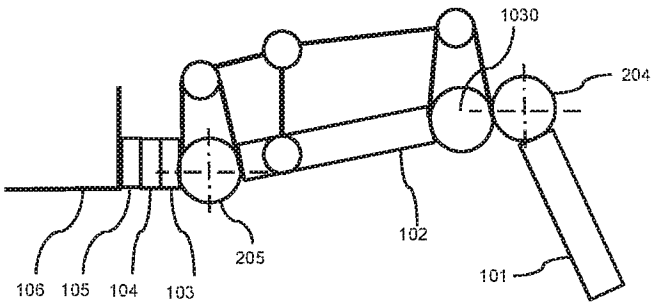
Figure 10A:
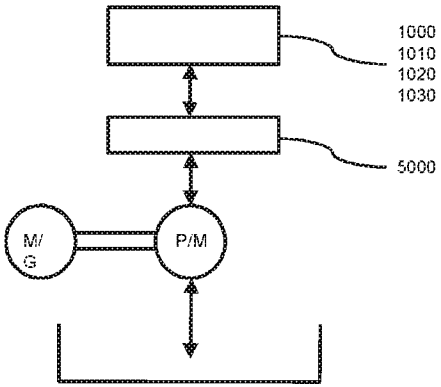
Figure 10B:
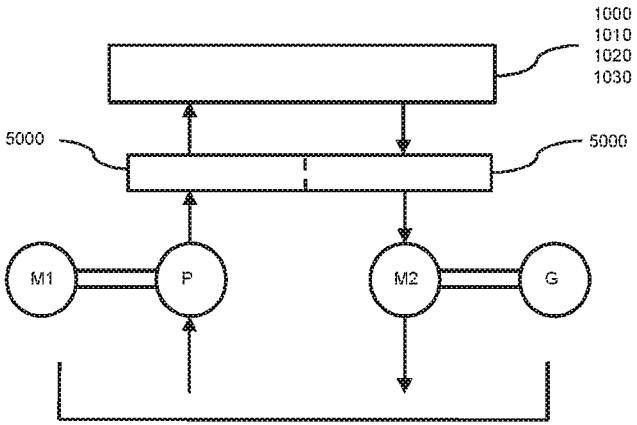

Side view or top view of an embodiment of an electric, hydraulic or pneumatic motor with a planetary system transmission in a second planetary system transmission of a joint or a lateral adjustment or a frame, wherein the motor is positioned in the transmission, is a cross section thereof in FIG. 7H.

FIG. 7I

Side view or top view of an embodiment of an electric, hydraulic or pneumatic motor with a Transmission or gearbox or deceleration mechanism of a Strain Wave Gear (Harmonic Drive) type, or a Wittenstein Galaxie type or a cycloid type transmission.

FIG. 8

Side view of an embodiment of different types of sensors in or on control members or between sections or between a lateral adjustment and a frame.

FIGS. 9A-9D

Side views of various embodiments of a hinge structure for moving a tool, or quick change system, or pivot and/or tilting joint or adapter relative to a second articulation.

FIG. 9A

Side view of a motor connected to a parallelogram structure on a second articulation for moving a tool, or quick change system, or pivot and/or tilt joint or adapter.

FIG. 10A

Schematic representation of an electric motor/generator (M/G), which supplies energy via a hydraulic or pneumatic pump/motor (P/M), via a valve (5000) to a control unit (1000-1030 in the form of a hydraulic or pneumatic motor or cylinder) to move this control and a joint. As soon as an articulation, and therefore a control unit, supplies energy, it is transmitted via a valve to the pump/motor (P/M), which drives the electric motor/generator thereon.

FIG. 10B

Schematic representation of an electric motor (M1), which supplies energy via a hydraulic or pneumatic pump (P/M), via a valve (5000) to a control unit (1000-1030 in the form of a hydraulic or pneumatic motor or cylinder) to move this control member and a joint. As soon as an articulation, and therefore a control element, supplies energy, it is transmitted via a different valve to a hydraulic or pneumatic motor (M2), which drives the electric generator thereon.

Those skilled in the art understand that the invention is not limited to the exemplary embodiments of the figures described above, and that many variants are conceivable within the scope of the invention.

The invention claimed is:

1. A mobile device comprising:

a frame with displacement means, a working arm connected to the frame and comprising at least a first and a second articulation which are hinged to each other, the working arm being pivotally connected to the frame, at least a first, second and third control device adapted to move the first and second articulation of the working arm and a tool, respectively, at a free end of the second articulation, a control system adapted to control the first, second and third control devices, wherein the control system is adapted to control the first, second and third control devices such that the free end of the second articulation follows a predetermined upward movement along an upwardly directed path and the tool remains in a lifting position, wherein the first, second and third control devices are driven simultaneously wherein the upwardly directed path meets one or more of the following conditions:

the upwardly directed path deviates less than 15°, from a vertical path;

the upwardly directed path is at least partially substantially vertical;

the upward path is such that the tool is more forward in relation to the frame in an end position than in an initial position;

the upwardly directed path comprises at least one curved part; and the upwardly directed path comprises a combination of a straight part and a slanted part and/or a curved part and/or a horizontal part.

2. The mobile device of claim 1, wherein a coupling structure is provided between the end of the second articulation and the tool, and the third control device is coupled to the coupling structure or to the tool.

3. The mobile device of claim 2, wherein the coupling structure is a quick-coupler system, or a swivel and/or tilting joint, or an adapter, or a hinge structure, or a parallelogram structure or a combination thereof.

4. The mobile device of claim 1, wherein the control system is further adapted to control the first, second and third control devices such that the free end of the second articulation has a predetermined substantially horizontal movement which follows a substantially horizontally oriented path and the tool remains in a lifting position, wherein the first, second and third control devices are driven simultaneously, the substantially horizontally oriented path deviating less than 10° from the horizontal.

5. The mobile device of claim 1, wherein the predetermined upward movement of the end of the second articulation follows a path starting in the lower position with a vertical part, then an oblique forward or curved forward part or a combination of oblique and curved, so that the end of the second articulation or the tool is further forward in the upper position than in the lower position.

6. The mobile device of claim 1, wherein the control system is further adapted to control the first, second and third control devices such that the free end of the second articulation performs a predetermined downward movement along a downward direction directional path follows and the tool remains in a lifting position, the first, second and third control devices being controlled simultaneously.

7. The mobile device of claim 6, wherein while following the predetermined downward movement, an angle between the frame and the first articulation first increases and then decreases, while the angle between the first articulation and the second articulation first decreases and then increases.

8. The mobile device of claim 7, wherein the downwardly directed path is substantially identical to the upwardly directed path.

9. The mobile device of claim 1, wherein the control system is adapted to adjust the position of the tool relative to the second articulation during the predetermined upward movement such that the tool performs a substantially vertical translation movement; and/or the control system is adapted to automatically hold the tool in the same position with respect to the frame during the predetermined upward movement and/or during a predetermined downward movement and/or during a substantially horizontal movement.

10. The mobile device of claim 1, wherein the frame is rotatable on a main frame via a pivot point; and/or wherein on or in the frame, the main frame or the pivot point between the frame and the main frame and/or a rotatable connecting piece between a frame and an articulation or between articulations comprises a sensor of the type linear, accelerator, gyroscope, rotation, angle, encoder, camera, a glass fiber, an optical fiber or a combination thereof to measure the movement of at least one of these parts.

11. The mobile device of claim 1, wherein the first articulation is pivotally connected to the frame via a pivot connection that has a rotation about a horizontal axis and a rotation about a vertical or substantially vertical axis; and/or wherein a pivot point of the second articulation coincides with a pivot point or engagement point of a control device; and/or wherein two or more control members generate the same control force, while the control members have substantially the same dimensions.

12. The mobile device of claim 1, wherein the first control device is located at least partially in a cavity on a lower side of the first articulation and that the second control device is at least partially in a cavity on an upper side of the first articulation is located; and/or wherein the second and/or first and/or third articulation has a hollow space in which the third and/or second and/or first and/or third control for the movement of another of these articulations or of the tool may be active.

13. The mobile device of claim 1, wherein the working arm and/or the tool are provided with one or more supports and that the frame is provided with a guide for the one or more supports, wherein the guide is adapted to guide the movement of the working arm and/or the tool during the predetermined upward movement, and/or wherein the one or more supports comprise at least a first and a second support provided on opposite sides of the second articulation; and/or wherein the control system is further adapted to guide the one or more supports along the guide during the predetermined upward and/or downward movement; and/or wherein the guide comprises one or more upwardly directed surfaces against which the one or more supports are guided; and/or wherein the frame is further provided with a stop, for stopping the predetermined downward movement; and /or wherein the at least one support is mounted or can rotate about a pivot point or an axis on the second articulation over which a coupling structure or a tool can move or rotate; and/or further comprising at least one brake to stop or block the movement of the first and/or the second and/or the third articulation.

14. The mobile device of claim 13, wherein the one or more supports comprise at least a first and a second support provided on opposite sides of the second articulation; wherein at least one articulation of the working arm has a hollow space in which a control device for the movement of this articulation can be active, and/or at least one articulation of the working arm has a cavity in which a control device for the movement of this articulation may be operative, and/or that at least one section consists of a structure of at least three walls, wherein a wall consists of at least one plate or more plates with multiple settlements or consists of a structure with a cross-section with a circular shape or elliptical shape or at least one square or trapezoidal shape or two trapezoidal shapes, and/or that at least one third articulation consists of a structure with at least three walls, wherein at least two engagement points of two control devices are positioned and in which pipes, hoses or electrical or electronic cables are located next to a control device for control of the third articulation are positioned, and/or that with at least the second articulation, pipes, hoses or cables can move down against a smooth side wall of a wear-resistant smooth material during the rotation of the second articulation.

15. The mobile device of claim 1, wherein at least one support on one side of the second articulation and/or a second support on another side of the second articulation connected to a coupling structure or to a tool can move or rotate in the same line as a pivot point between the second articulation and the coupling structure or tool; and/or wherein at least the end of the second articulation follows a guide on the frame or on the main frame via a shaft or support or on a moving part thereof during the predetermined up or down movement; and/or that the at least one third guide is movable with respect to the frame or the main frame or a moving part thereof; and/or wherein the at least one support is guided laterally by a guide; and/or that the at least one support is guided by a funnel-shaped guide, and/or wherein the, or each, control device is a hydraulic cylinder, or is a hydraulic motor, or is an electric motor, or is an electric spindle or is an electric solenoid, or is a pneumatic cylinder, or a pneumatic motor, and/or wherein energy recovery means are provided which are adapted to recover energy during the rotation of the first and/or second and/or third articulation, and/or wherein energy recovery means are provided which are adapted to recover energy:

when the first section moves up and uses energy and at the same time the second section moves in and supplies energy; and/or when the first articulation or the second articulation moves up and consumes energy and supplies energy to the third controller; and/or when a control device for an articulation uses energy and another control device for a different articulation simultaneously recovers energy.

16. A mobile device comprising:

a frame with displacement means, a working arm connected to the frame and comprising at least a first and a second articulation which are hinged to each other, the working arm being pivotally connected to the frame, at least a first, second and third control device adapted to move the first and second articulation of the working arm and a tool, respectively, at a free end of the second articulation, a control system adapted to control the first, second and third control devices, wherein the control system is adapted to control the first, second and third control devices such that the free end of the second articulation follows a predetermined upward movement along an upwardly directed path and the tool remains in a lifting position, wherein the first, second and third control devices are driven simultaneously, wherein while following the predetermined upward movement, an angle between the frame and the first articulation increases, while an angle between the first articulation and the second articulation first decreases and then increases.

17. A mobile device comprising:

a frame with displacement means, a working arm connected to the frame and comprising at least a first and a second articulation which are hinged to each other, the working arm being pivotally connected to the frame, at least a first, second and third control device adapted to move the first and second articulation of the working arm and a tool, respectively, at a free end of the second articulation, a control system adapted to control the first, second and third control devices, wherein the control system is adapted to control the first, second and third control devices such that the free end of the second articulation follows a predetermined upward movement along an upwardly directed path and the tool remains in a lifting position, wherein the first, second and third control devices are driven simultaneously, wherein the working arm comprises an third articulation between the frame and the first articulation, the third articulation being connected by means of pivot points with the first articulation and with the frame.

18. The mobile device of claim 17, wherein a coupling structure is provided between the end of the second articulation and the tool, and that the third control device is coupled to the coupling structure or to the tool, and wherein the control system is further adapted to control the third control device during the movement of the tool or the coupling structure;

and/or wherein the control system is further adapted to control the third control device:

during the movement of the first articulation, so that the end of the second articulation can reach a greater height; and/or so that the end of the second articulation can extend further from the frame; and/or such that movement over a pivot point between the frame and the third articulation is blocked as soon as the third articulation moves into a reclined position; and/or such that movement over a pivot point between the main frame and the frame is blocked as soon as the third articulation moves into a reclined position; and/or such that the third articulation is blocked in an extremely backward position.

* * * * *